US006874485B2

(12) United States Patent
Fujimoto

(10) Patent No.: US 6,874,485 B2
(45) Date of Patent: Apr. 5, 2005

(54) DEVICE FOR DETECTING CANISTER DETERIORATION

(75) Inventor: Takeshi Fujimoto, Obu (JP)

(73) Assignee: Denso Corporation (JP)

( * ) Notice: Subject to any disclaimer, the term of this patent is extended or adjusted under 35 U.S.C. 154(b) by 8 days.

(21) Appl. No.: 10/407,178

(22) Filed: Apr. 7, 2003

(65) Prior Publication Data

US 2003/0183206 A1 Oct. 2, 2003

Related U.S. Application Data

(62) Division of application No. 10/078,452, filed on Feb. 21, 2002, now Pat. No. 6,564,782.

(30) Foreign Application Priority Data

Feb. 21, 2001 (JP) ..... 2001-45258
Mar. 14, 2001 (JP) ..... 2001-72610

(51) Int. Cl.[7] ..... F02M 33/02
(52) U.S. Cl. ..... 123/520; 123/198 D; 73/119 A
(58) Field of Search ..... 123/198 D, 521, 123/520, 519, 518, 516; 23/119 A, 117.2, 117.3, 116, 118.1

(56) References Cited

U.S. PATENT DOCUMENTS 5,085,194 A 2/1992 Kuroda et al.
5,216,991 A * 6/1993 Iida et al. ..... 123/339.23
5,251,592 A 10/1993 Seki et al.
5,327,873 A 7/1994 Ohuchi et al.
5,443,051 A 8/1995 Otsuka
5,505,182 A 4/1996 Denz et al.
5,609,141 A * 3/1997 Matsuoka et al. ..... 123/520
5,780,728 A 7/1998 Takamori
6,089,080 A * 7/2000 Takaku et al. ..... 73/117.3
6,253,750 B1 * 7/2001 Duty et al. ..... 123/674
6,336,446 B1 1/2002 Isobe et al.
6,357,288 B1 3/2002 Shigihama et al.
6,397,829 B1 * 6/2002 Toyoda ..... 123/674
6,488,748 B2 * 12/2002 Yamafuji et al. ..... 96/131

FOREIGN PATENT DOCUMENTS

JP 4-265457 9/1992

* cited by examiner

*Primary Examiner*—Carl S. Miller
(74) *Attorney, Agent, or Firm*—Nixon & Vanderhye PC

(57) ABSTRACT

A fuel evaporation control system is connected to an engine control system in which an air-fuel ratio in mixture gas supplied to an engine is controlled to an optimum level. Fuel evaporated from a fuel tank is absorbed by a canister, and the absorbed fuel is purged into the engine. Deterioration of the canister in its air-permeability is detected based on measured pressure in the fuel evaporation control system or calculated density in the purge gas, both the pressure and the density being measured or calculated under two different amounts of purge gas flow. Deterioration of the canister in its fuel-absorbing ability is also detected based on the purge gas density.

16 Claims, 19 Drawing Sheets

DEVICE FOR DETECTING CANISTER DETERIORATION

CROSS-REFERENCE TO RELATED APPLICATIONS

This application is a division of U.S. application Ser. No. 10/078,452, filed Feb. 21, 2002, now U.S. Pat. No. 6,564, 782.

This application is based upon and claims benefit of priority of Japanese Patent Applications No. 2001-45258 filed on Feb. 21, 2001 and No. 2001-72610 filed on Mar. 14, 2001, the contents of which are incorporated herein by reference.

BACKGROUND OF THE INVENTION

1. Field of the Invention

The present invention relates to a fuel evaporation control system for use in an automobile vehicle, and more particularly to a device for detecting deterioration of a canister used in the fuel evaporation control system.

2. Description of Related Art

A fuel evaporation control system in which gaseous fuel evaporated from a fuel tank of an automobile vehicle is absorbed by a canister and the absorbed fuel is purged into an intake pipe of an engine is known hitherto. The canister is composed of activated charcoal for absorbing the evaporated fuel and a filter for removing dusts contained in the atmospheric air. The canister is connected to a fuel tank, the intake pipe and the atmosphere through respective passages. An amount of fuel purged into the intake pipe is controlled by a control valve installed between the canister and the intake pipe.

JP-A-6-506514 and JP-A-4-265457 disclose such a fuel evaporation control system, and more particularly a technique for detecting an increase in a flow resistance in the canister. In the system disclosed in JP-A-6-506514, a negative pressure is introduced in the fuel evaporation control system, and then a purge control valve is closed. Under this situation, an atmospheric pressure and an in-tank pressure are measured. Then, a difference between both pressures is compared with a predetermined criterion value. If the pressure difference exceeds the criterion value for a predetermined period of time, it is determined that the flow resistance through the canister is abnormally increased. In other words, it is determined that the canister is deteriorated.

However, in the technique disclosed, the criterion value for determining the canister deterioration is set based on various parameters such as engine speed, an engine load, a duty ratio of the purge control valve. Accordingly, a complex process is required in setting the criterion value. Also, it is difficult to precisely determine the canister deterioration because an amount of fuel vaporizing from the fuel tank differs depending on driving conditions of the engine. Further, in the systems disclosed in both JP-A-6-506514 and JP-A-4-265457, deterioration of fuel-absorbing ability of the canister cannot be detected.

SUMMARY OF THE INVENTION

The present invention has been made in view of the above-mentioned problems, and an object of the present invention is to provide an improved fuel evaporation control system in which deterioration in air permeability and fuel-absorbing ability of the canister is accurately detected with high accuracy using a simple structure and a process.

Air-fuel ratio in a mixture gas supplied to an internal combustion engine is electronically controlled by an electronic control unit. A fuel evaporation control system is connected to such an engine control system to purge evaporated fuel from a fuel tank into the engine. The fuel evaporation control system includes a fuel tank, a canister and a control valve for controlling an amount of purge gas purged into the engine. The canister is composed of activated charcoal and a filter for removing foreign particles contained in atmospheric air. Fuel evaporated from the fuel tank is absorbed by activated charcoal in the canister, and the absorbed fuel is purged into the engine by negative pressure in an intake pipe of the engine. The amount of negative pressure in the fuel evaporation control system, which is represented by an in-tank fuel pressure, is measured by a pressure sensor.

Air-permeability in the canister decreases due to deterioration of the canister. The in-tank pressure decreases as the air-permeability in the canister decreases since a sufficient amount of air is not taken in through the canister in this case. In other words, an amount of negative pressure in the fuel evaporation control system increases according to decrease of the air-permeability in the canister. The amount of such pressure decrease becomes larger as an amount of purge flow fed to the engine becomes larger. The in-tank pressure is measured under a low purge flow and a high purge flow, and a pressure difference between two in-tank pressures measured in such a manner is compared with a predetermined criterion. If the pressure difference exceeds the criterion, it is determined that the air-permeability in the canister is abnormally low.

Since the in-tank pressure is measured under two different amounts of purge flow, and the pressure difference is compared with a predetermined criterion, the air-permeability decrease, or the flow resistance increase, in the canister is accurately detected in a simple process. The in-tank pressure may be measured after a predetermined period of time has lapsed after the amount of purge flow reaches a predetermined level, a low level or a high level, in order to obtain stabilized in-tank pressure. The detection of the air-permeability may be prohibited when the system is not normally operating or a purge gas density is too high to avoid misjudgment of the air-permeability in the canister. When the abnormally low air-permeability is detected, air-fuel ratio control system may be switched to a fail-safe mode in which an abrupt change in the air-fuel ratio is avoided.

In the air-fuel ratio control, an amount of fuel injected from injectors is adjusted according to an amount of fuel purged from the fuel evaporation control system in order to control the air-fuel ratio at a desired level. In this process, a purge gas density is calculated under a learning procedure. Fuel-absorbing ability of the canister is detected based on the calculated, or learned, purge gas density. The purge gas density decreases in a short period of time during the purging process if the fuel-absorbing ability becomes low due to deterioration of the canister. The highest level of purge gas density at a given purging process is calculated and memorized. When a predetermined period of time has lapsed after the purge gas density reached the highest level, the level of the purge gas density at that time is compared with the highest level. If a difference between the highest level and the present level exceeds a predetermined criterion, it is determined that the fuel-absorbing ability of the canister is abnormally low. Thus, abnormality in the fuel-absorbing ability is accurately detected based on the purge gas density. The predetermined period of time may be calculated by integrating the purge gas density in the purging process.

The air-permeability in the canister is also detected based on the purge gas density. The purge gas density at a low amount of purge gas flow is compared with the purge gas density at a high amount of purge flow. If the difference exceeds a predetermined amount, it is determined that the air-permeability of the canister is abnormally low. The air-permeability decrease due to deterioration of the canister is accurately detected in a simple manner.

According to the present invention, deterioration of the canister both in its air-permeability and in its fuel-absorbing ability is accurately detected in a simple manner.

Other objects and features of the present invention will become more readily apparent from a better understanding of the preferred embodiments described below with reference to the following drawings.

DETAILED DESCRIPTION OF THE PREFERRED EMBODIMENTS (First Embodiment)

Figure 1:
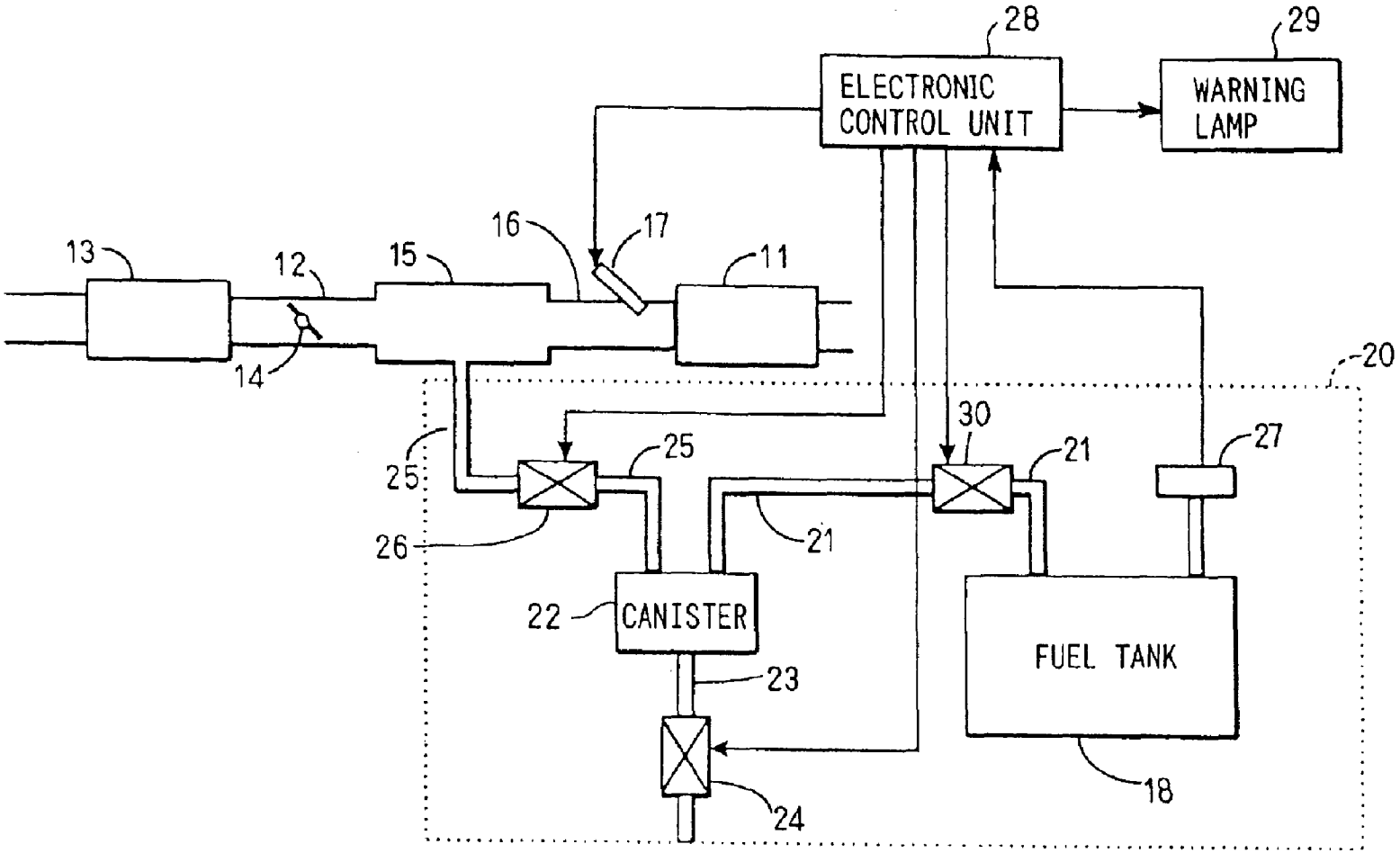
FIG. 1 is a block diagram showing a fuel evaporation control system as a first embodiment of the present invention.

A first embodiment of the present invention will be described with reference to FIGS. 1–14. First, referring to FIG. 1, an entire structure of a fuel evaporation control system will be described. Outside air is introduced into an internal combustion engine 11 through an air cleaner 13, an intake pipe 12 having a throttle valve 14, a surge tank 15, and an intake manifold 16. A fuel injector 17 is disposed in the intake manifold 16 of each cylinder. Fuel in a fuel tank 18 is sent to the fuel injector 17 through a fuel passage (not shown).

A fuel evaporation control system 20 is connected to the surge tank 15. A canister 22 is connected to the fuel tank 18 through a vapor passage 21, and a tank-cut valve 30 is disposed in the vapor passage 21. The canister 22 contains activated charcoal for absorbing fuel evaporated from the fuel tank 18. An outlet passage 23 is connected to a bottom hole of the canister 22, and an outlet valve 24 communicating with atmospheric air is connected to the outside end of the outlet passage 23. The outlet valve 24 is composed of a normally open electromagnetic valve that is open when it is not energized and is closed when energized.

The canister 22 is connected to the surge tank 15 through a surge passage 25, so that evaporated fuel absorbed by the canister 22 is purged into the surge tank 15. A purge control valve 26 is disposed in the purge passage 25. The purge control valve 26 is composed of a normally closed electromagnetic valve that opens with a controlled duty ratio when it is energized. The amount of purge gas flow supplied to the engine 11 is controlled by the purge control valve 26.

A pressure sensor 27 for detecting an in-tank pressure of the fuel tank 18 is connected to the fuel tank 18. When passages from the fuel tank 18 to the purge control valve 26 in the fuel evaporation control system are closed, the in-tank pressure coincides with the pressure in the system. Accordingly, the pressure in the fuel evaporation control system is represented by the in-tank pressure. Outputs from the pressure sensor 27 are fed to an electronic control unit 28. The electronic control unit 28 is composed of a microcomputer, ROMs and other components. Programs for controlling a fuel injection system, an ignition system and a purge control system are memorized in the ROMs. Those systems are all controlled by the electronic control unit 28.

Figure 2:
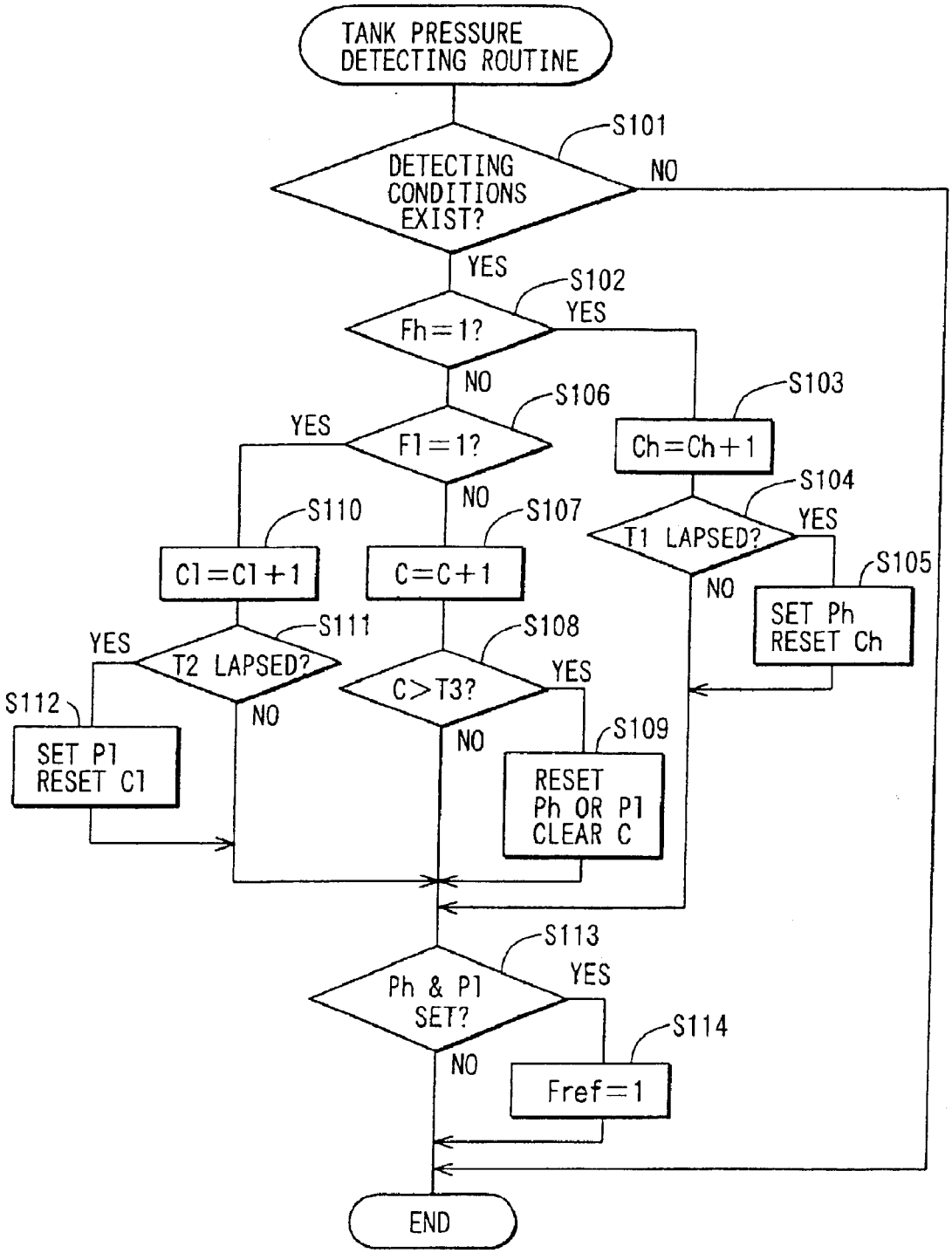
FIG. 2 is a flowchart showing a process of detecting an in-tank pressure under two different amounts of purge gas flow.

FIG. 2 shows a flowchart of a program for detecting the in-tank pressure. Decrease in air permeability in the canister 22 is detected by comparing two in-tank pressures measured under different amounts of purge gas flow. The process for detecting the in-tank pressure will be described with reference to FIG. 2. At step S101, whether conditions for detecting abnormality of the canister 22 are satisfied is determined. The conditions are satisfied if: a purge gas density is within a predetermined range; the fuel evaporation control system and sensors are normally operable; and programs for diagnosing other functions than the fuel evaporation are not being carried out. The purge gas density is detected by a well-known method, e.g., according to changes of an air-fuel ratio adjusting factor caused by purging the evaporated gas into the intake pipe. If the purge gas density is higher than a predetermined level, it is not proper to perform the canister abnormality detection, because the air-fuel ratio may become too fuel-rich and the air-fuel ratio may abruptly changes when the evaporated gas is purged into the intake pipe. If the evaporated gas purging system and sensors are not normally operable, it is not proper to perform the canister abnormality detection. Further, if other diagnosis programs affecting the canister diagnosis, such as a leakage check or malfunction detection of the purge control valve, are being carried out, the canister abnormality detection is not performed. Only when those conditions are satisfied, the process proceeds to the next steps S102 and S106, and otherwise the process proceeds to the end of the program. Alternatively, when those conditions are not satisfied, the canister abnormality detection may be prohibited.

At steps S102 and S106, an amount of the purge flow is checked. The amount of purge flow is determined by the in-tank pressure and the pressure in the surge tank 15, assuming a cross-sectional area of the purge passage is uniform. The in-tank pressure is substantially equal to an atmospheric pressure because the outlet valve 24 is open when a normal purge control is carried out. Accordingly, the amount of purge flow is determined by the pressure in the surge tank 15 and the cross-sectional area of the purge passage 25. The pressure in the surge tank 15 is referred to as an intake negative pressure. To obtain a desired amount of purge flow under various driving conditions of the engine, the amount of purge flow is controlled by changing the duty ratio for opening the normally closed purge control valve 26. The duty ratio of the purge control valve 26 (an effective degree of opening) may be controlled based on a map set by experiments and memorized in the electronic control unit 28. Alternatively, it may be calculated by the electronic control unit 28.

If the air permeability in the canister 22 is decreased by deterioration of the canister 22, the pressure in the fuel tank 18 (the in-tank pressure) becomes negative when the purge control is carried out, because the outlet passage 23 is brought to a partially closed state even though the outlet valve 24 is open. If the air permeability in the canister 22 is low, the in-tank pressure is not maintained at a level substantially equal to the atmospheric pressure. Accordingly, a desired amount of purge flow may not be obtained by controlling the purge control valve 26.

Now, steps S102 and S106 in the flowchart shown in FIG. 2 will be explained. At step S102, a flag Fh is set (Fh=1) if conditions for detecting the in-tank pressure under a high range of the purge flow are satisfied. At step S106, a flag Fl is set (Fl=1) if conditions for detecting the in-tank pressure under a low range of the purge flow are satisfied.

Figure 3:
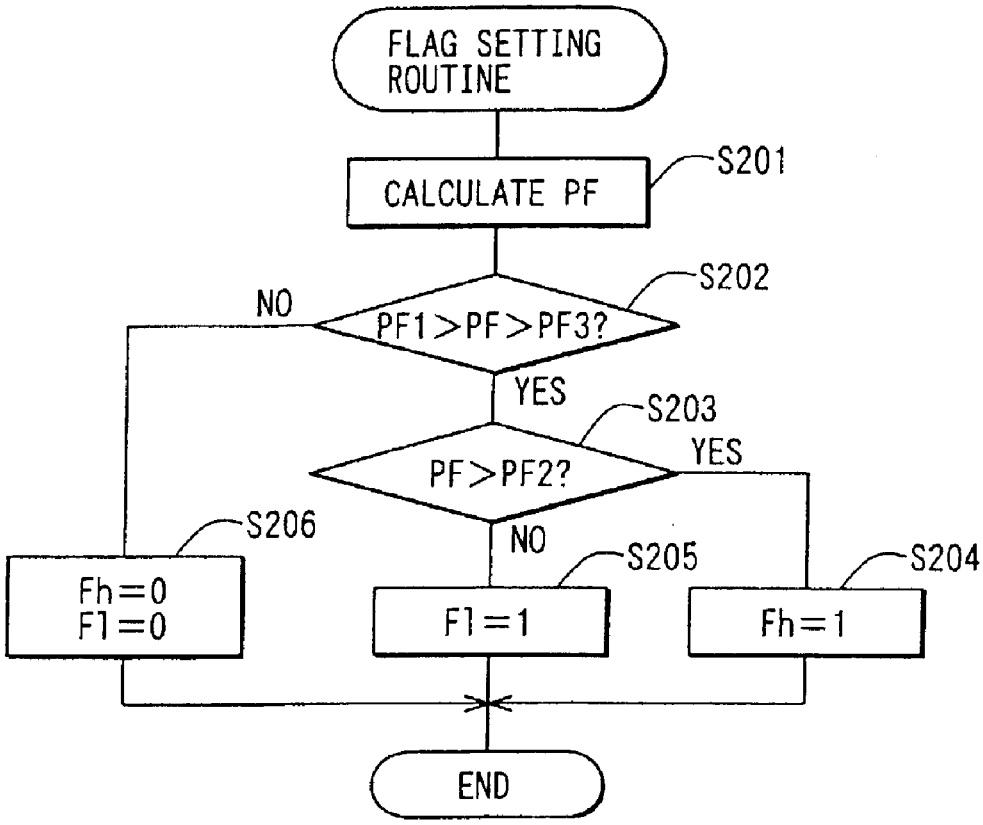
FIG. 3 is a flowchart showing a process of setting flags indicating an amount of the purge flow in the process shown in FIG. 2.
Figure 4:
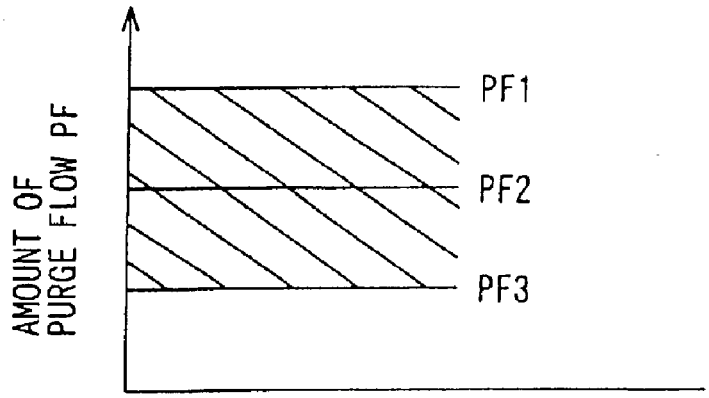
FIG. 4 is a graph showing levels of predetermined amounts of the purge flow.

The process of setting flags Fh and Fl is shown in FIG. 3. At step S201, an amount of purge flow PF is calculated based on the opening degree of the purge control valve 26 and the intake negative pressure. At step S202, whether the amount of purge flow PF is lower than a first predetermined amount PF1 and higher than a third predetermined amount PF3 is determined (PF1<PF<PF3). If PF is within this range, the process proceeds to the next step S203, where whether PF is higher than a second predetermined amount PF2 is determined (PF>PF2). The relation among three predetermined amounts, PF1, PF2, PF3, is shown in FIG. 4. PF1 is the highest, PF3 is the lowest and PF2 is between PF1 and PF2. If it is determined that PF is higher than PF1 or lower than PF3 (PF is out of the predetermined range) at step S202, the process proceeds to step S206, where both flags Fh and Fl are set to zero (Fh=0, Fl=0) and this routine comes to the end. If it is determined that PF is higher than PF2 (PF is in a higher range) at step S203, the process proceeds to step S204, where the flag Fh is set (Fh=1) and this routine comes to the end. If it is determined that PF is lower than PF2 (PF is in a lower range) at step S203, the process proceeds to step S205, where the flag Fl is set (Fl=1) and the routine comes to the end.

Figure 5:
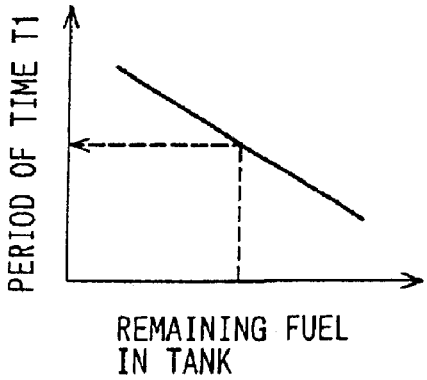
FIG. 5 is a graph showing a relation between a predetermined period of time T1 and an amount of fuel remaining in a fuel tank.

At steps S102 and S106 shown in FIG. 2, the flags Fh and Fl are set in the manner described above. If the flag Fh is set at step S102, the process proceeds to steps S103–S105, where the in-tank pressure at the higher purge flow range is detected. At step S103, a counter Ch is incremented, and then the process proceeds to step S104. At step S104, whether the value of the counter Ch exceeds a first predetermined period of time T1 is determined. In other words, whether the first predetermined time T1 has lapsed or not after the amount of purge flow PF was set in the higher purge flow range is determined at step S104. This is because a certain period of time after the purge flow reaches a certain level is required to obtain a stabilized in-tank pressure. The in-tank pressure becomes unstable for a certain period after the amount of purge flow is changed because an amount of vaporized fuel changes according to changes of the amount of purge flow. This is especially notable when an amount of fuel remaining in the fuel tank 18 is small. Therefore, as shown in FIG. 5, the first predetermined time T1 is set longer when the amount of fuel remaining in the fuel tank is smaller. Alternatively, the first predetermined time T1 may be set to a constant level, if it is required to decrease a calculation load in the electronic control unit. After the first predetermined time T1 has lapsed, the process proceeds to step S105, where the in-tank pressure Ph under the higher purge flow range is detected and memorized in the electronic control unit 28, and the counter Ch is reset. Then, the process proceeds to step S113. If it is determined at step S104 that the first predetermined time T1 has not lapsed, the process directly proceeds to step S113.

Figure 6:
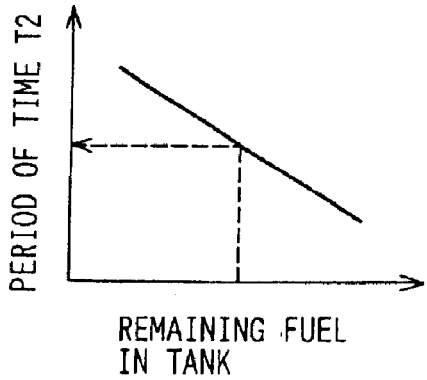
FIG. 6 is a graph showing a relation between a predetermined period of time T2 and an amount of fuel remaining in a fuel tank.

On the other hand, the flag Fl is set at step S106, the process proceeds to step S110, where a counter Cl is incremented. Then, at step S111, whether the value of the counter Cl exceeds a second predetermined time T2 is determined. In other words, whether the second predetermined time T2 has lapsed after the purge amount has been set to the lower range is determined. For the same reason mentioned as to the first predetermined time T1, the second predetermined time T2 is set according to the amount of fuel remaining in the fuel tank 18, as shown in FIG. 6. After the second predetermined time T2 has lapsed, the process proceeds to step S112, where the in-tank pressure Pl under the lower purge flow range is detected and memorized in the electronic control unit 28, and the counter Cl is reset. Then, the process proceeds to step S113. If the second predetermined time T2 has not lapsed, the process directly proceeds to step S113.

If the flag Fl is not set (Fl=0) at step S106, the process proceeds to steps S107–S109, where the in-tank pressure memorized in the electronic control unit 28 is reset when a predetermined time has lapsed after either one of the in-tank pressure Ph or Pl is detected. This is done because reliability of detection of the canister abnormality is not secured, if a longer period of time lapses by a time to detect a present in-tank pressure after a previous in-tank pressure has been detected and memorized. Instead of resetting the in-tank pressure memory, the canister abnormality detection may be prohibited if a predetermined period of time has lapsed after a first in-tank pressure is detected. More particularly, at step S107, a counter C is incremented. Then, process proceeds to step S108, where whether a third predetermined time T3 has lapsed is determined. If the third predetermined time T3 has lapsed, the in-tank pressure Ph or Pl memorized in the electronic control unit 28 is cleared (reset) at step S109. At the same time, the counter C is reset and the process proceeds to step S113. If it is determined that the third predetermined time T3 has not lapsed at step S108, the process directly proceeds to step S113.

At step S113, whether both of the in-tank pressures Ph under the higher purge flow range and Pl under the lower purge flow range are set or not is determined. If both in-tank pressures Ph and Pl are set, the process proceeds to step S114, where a flag Fref for performing canister abnormality detection is set, completing this routine. If it is determined that both pressures Ph and Pl are not set at step S113, the process directly proceeds to the end of the routine.

Figure 7:
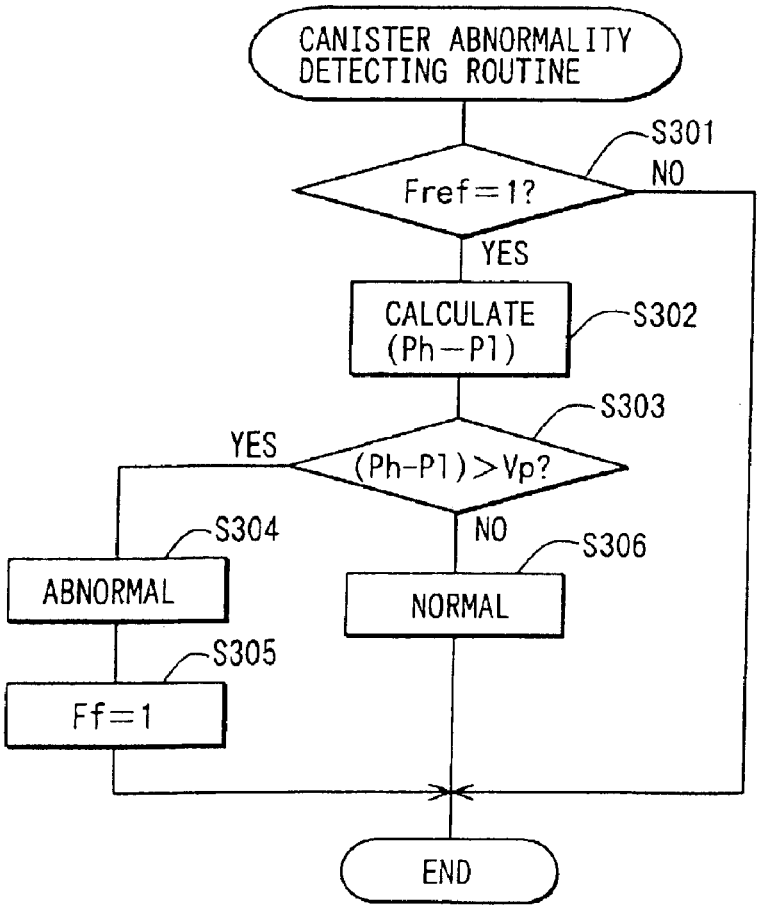
FIG. 7 is a flowchart showing a process of judging abnormality of the canister.

Referring to FIG. 7, a process for detecting the canister abnormality, i.e., the air permeability decrease in the canister 22, will be described. At step S301, whether the flag Fref for performing the canister abnormality detecting process is set (Fref=1) is determined. If the flag Fref is not set, the process comes to the end. If the flag Fref is set, the process proceeds to step S302, where the in-tank pressure Ph under the higher purge flow range and the in-tank pressure Pl under the lower purge flow range are read out from the memory, and a difference between Ph and Pl (Ph−Pl) is calculated. Then, at step S303, whether the in-tank pressure difference (Ph−Pl) is larger than a criterion Vp for detecting the canister abnormality is determined.

Figure 8:
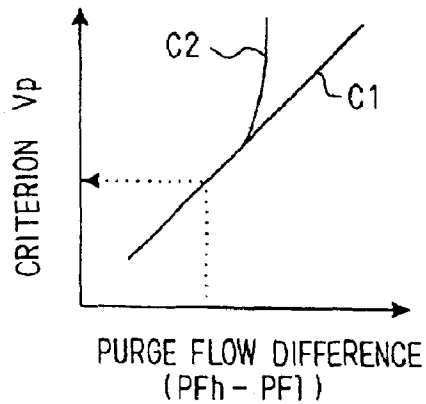
FIG. 8 is a graph showing a relation between a criterion value for determining the canister abnormality and a difference of two amounts of purge flow.

The criterion Vp is set according to the difference between the amount of the higher purge flow PFh under which Ph is detected and the amount of the lower purge flow PFl under which Pl is detected, as shown in FIG. 8. The criterion Vp is set to a higher level as the difference of the amount of purge flow (PFh−PFl) becomes larger, because the pressure difference (Ph−Pl) is higher when the purge flow difference (PFh−PFl) is larger. The level of the criterion Vp may be set in proportion to the purge flow difference as shown by line Cl, or it may be further increased in a region where the purge flow difference is high as shown by curve C2.

If it is determined at step S303 that the in-tank pressure difference (Ph−Pl) is smaller than the criterion Vp, it is determined that the canister 22 is normal (step S306). Then the process comes to the end. If the in-tank pressure difference is larger than the criterion Vp, it is determined that the canister 22 is abnormal (step S304), i.e., the air permeability in the canister is abnormally low. If the canister abnormality is detected, the process moves to step S305, where a flag Ff for performing a fail-safe mode process is set (Ff=1). Then, the process comes to the end. The fail-safe mode process will be described later.

The above-described process for detecting the canister abnormality will be further explained with reference to a timing chart shown in FIG. 9. Whether the conditions for detecting the canister abnormality exist or not is shown by graph (a) of the timing chart. This is determined at step S101 in the process shown in FIG. 2. The amount of purge flow is shown by graph (b), and the in-tank pressure is shown by graph (c) in the flow chart.

The detection conditions are satisfied at time $t_0$, and the amount of purge flow becomes to fall within the predetermined range (a range between PF3 and PF1) at time $t_1$. At time $t_2$ when the second predetermined period of time T2 has lapsed from time $t_1$, the in-tank pressure is detected. Since a certain period of time is necessary, after the purge flow amount is set, to obtain a stabilized in-tank pressure, the in-tank pressure is detected at time $t_2$. At time $t_3$, the purge flow amount is switched to a higher level, and the purge flow amount reaches a higher level at time $t_4$. At time $t_5$ when the first predetermined period of time T1 has lapsed from time $t_4$, the in-tank pressure is detected. The reason for measuring the in-tank pressure after T1 has lapsed is to obtain the stabilized in-tank pressure.

As described above, the in-tank pressure Pl under the lower range of the purge flow is detected at point A, while the in-tank pressure Ph under the higher range of the purge flow is detected at point B. If a time distance between point A and point B exceeds a predetermined period of time, in-tank pressure data memorized in the electronic control unit 28 are canceled, considering the reliability of the canister abnormality detection.

Figure 9:
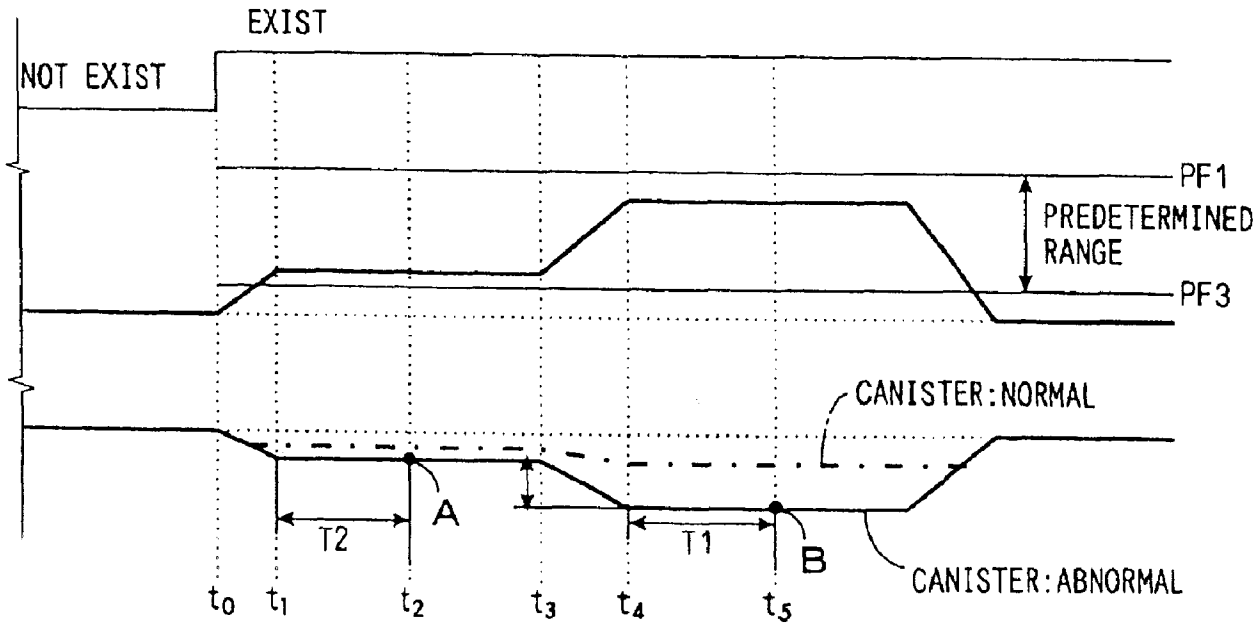
FIG. 9 is a timing chart showing a sequence in detecting deterioration in air permeability of the canister.

In FIG. 9(*c*), the in-tank pressure when the canister is normal is shown by a dotted line, and the in-tank pressure when the canister is abnormal is shown by a solid line. When the canister 22 is normal, the in-tank pressure is maintained at a level at a vicinity of the atmospheric pressure during the purging operation because the outlet valve 24 is kept open. When the canister 22 is abnormal, i.e., when its air permeability is abnormally low, the in-tank pressure becomes low due to the negative pressure in the surge tank 15. The degree of the in-tank pressure decrease depends on the amount of purge flow, i.e., the higher the amount of purge flow, the larger the pressure decrease. This phenomenon is utilized in detecting the air permeability decrease in the canister 22. The in-tank pressure difference between Ph (at point B) and Pl (at point A) is compared with the criterion Vp. If the pressure difference is larger than the criterion Vp, it is determined that the canister 22 is abnormal.

Though the in-tank pressure difference is compared with the criterion Vp in the foregoing embodiment, it is also possible to compare the ratio Ph/Pl with another criterion. Further, the in-tank pressure may be integrated for a certain period, and the integrated value may be compared with a criterion in detecting the canister abnormality.

Figure 12:
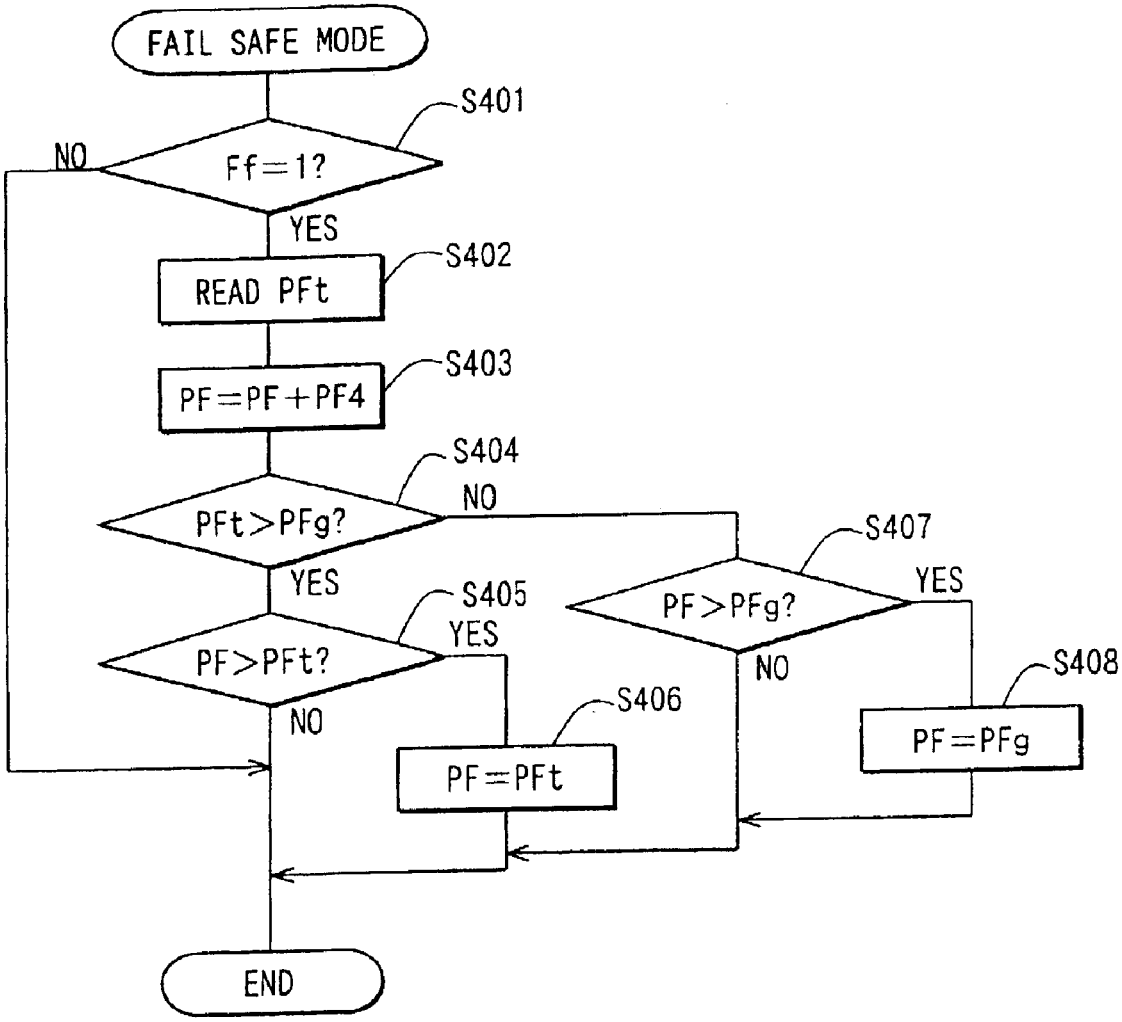
FIG. 12 is a flowchart showing a process of performing a fail-safe mode.

Now, the fail-safe mode process to be performed when the fail-safe mode flag Ff is set in the canister abnormality detecting process shown in FIG. 7 will be described with reference to FIG. 12. This process is performed when the abnormality in the canister 22 is detected. At step S401, whether the fail-safe mode flag Ff is set is checked. If the flag Ff is not set, the process directly comes to the end. If the flag Ff is set, the process proceeds to step S402, where a target amount of purge flow PFt is read out from the ROM in the electronic control unit 28. Then, at the next step S403, a final purge amount PF is calculated by adding a fourth predetermined purge flow amount PF4 to a previous purge amount. PF4 is set to an amount smaller than an amount usually used for gradually changing the purge flow amount, in order to avoid abrupt changes in the air-fuel ratio in controlling the purge flow amount to follow the target amount PFt. When the air permeability in the canister 22 decreases, a desired amount of purge flow cannot be supplied to the intake pipe 12, and thereby the air-fuel ratio may be shifted from a target level. PF4 is set to a small amount to avoid an abrupt change in the air-fuel ratio and to be able gradually follow the desired air-fuel ratio under the feedback control though the desired air-fuel ratio is not rapidly realized.

At step S404, whether the target purge flow amount PFt is larger than a safeguarded purge flow amount PFg is determined. If PFt is smaller than PFg, the process proceeds to step S407, where whether the final purge flow amount PF calculated at step S403 exceeds the guarded level PFg (PF>PFg?) is determined. If not, the process comes to the end. If PF is larger than PFg, the process proceeds to step S408, where the final PF is set to the guarded level PFg. Then, the process comes to the end.

On the other hand, if it is determined that the target purge flow amount PFt is larger than the guarded level PFg at step S404, the process proceeds to step S405, where whether the final purge flow amount PF exceeds the target amount PFt is determined. If not, the process directly comes to the end. If the final PF exceeds PFt, the process proceeds to step S406, where the final PF is set to PFt. Then, the process comes to the end.

The fail-safe mode is carried out as described above. The air-fuel ratio deviation is kept small by performing the process for guarding the amount of purge flow, even if a desired amount of purge flow is not obtained due to the air permeability decrease in the canister 22. Since the evaporated fuel is purged into the intake pipe within a range in which the feedback control of the air-fuel ratio is possible, disturbance of the air-fuel ratio can be avoided. In other words, the shift of the air-fuel ratio caused by the purge control is rectified by the feedback control. Under the fail-safe mode, the evaporated fuel absorbed to the canister 22 can be gradually purged into the intake pipe 12 without disturbing the air-fuel ratio even when the air permeability in the canister abnormally decreases.

Figure 10:
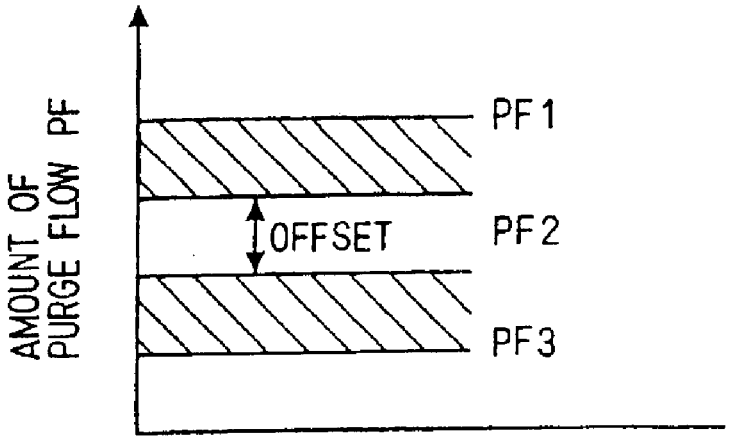
FIG. 10 is a graph showing modified levels of predetermined amounts of the purge flow.

The first embodiment described above may be variously modified. Some examples of the modification will be described below. In the above-described embodiment, the in-tank pressure Ph is detected in the higher purge flow range (between PF1 and PF2) and the in-tank pressure Pl is detected in the lower purge flow range (between PF2 and PF3). If both the Ph and Pl are detected at a purge flow in a vicinity of PF2, the pressure difference between Ph and Pl may not be large enough to effectively detect the air permeability decrease in the canister. As shown in FIG. 10, a certain gap (an offset) between the higher range and the lower range of the purge flow may be provided to obtain a large pressure difference between Ph and Pl and thereby to detect the air permeability decrease in the canister without fail. Alternatively, instead of providing the offset, it is possible to detect Ph and Pl at respective levels of purge flow which are apart from each other by a predetermined amount.

Figure 11:
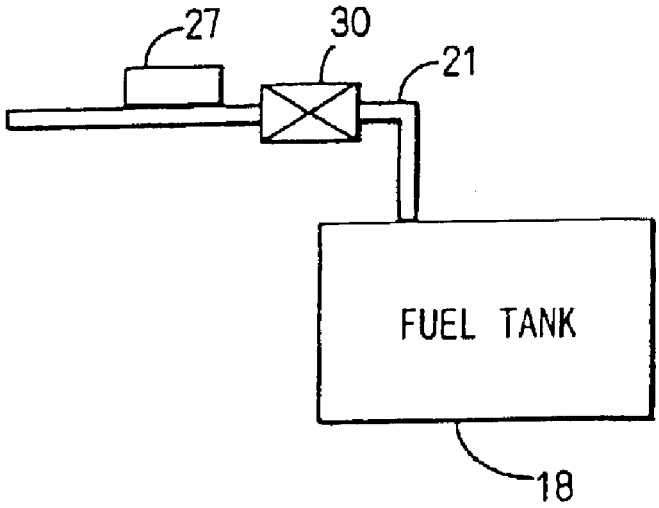
FIG. 11 is a partial block diagram showing a modified form of the first embodiment shown in FIG. 1.

The in-tank pressure Ph and Pl are detected, in the above-described embodiment, after the predetermined period T1 and T2 lapsed from setting of the respective amounts of purge flow. The waiting time T1, T2 may be eliminated by slightly modifying the position of the pressure sensor 27 in the fuel evaporation control system 20. That is, as shown in FIG. 11, the pressure sensor 27 is positioned downstream of the tank-cut valve 30. Upon setting the amount of purge flow under which the in-tank pressure Ph, Pl is to be detected, the tank-cut valve 30 is closed to quickly stabilize the detected pressure. In this manner, the waiting time T1, T2 can be eliminated. The tank-cut valve 30 may be closed only when the amount of fuel remaining in the fuel tank 18 is small, because an amount of fuel evaporating from the fuel tank 18 becomes large especially when the remaining fuel amount is small.

Figure 13:
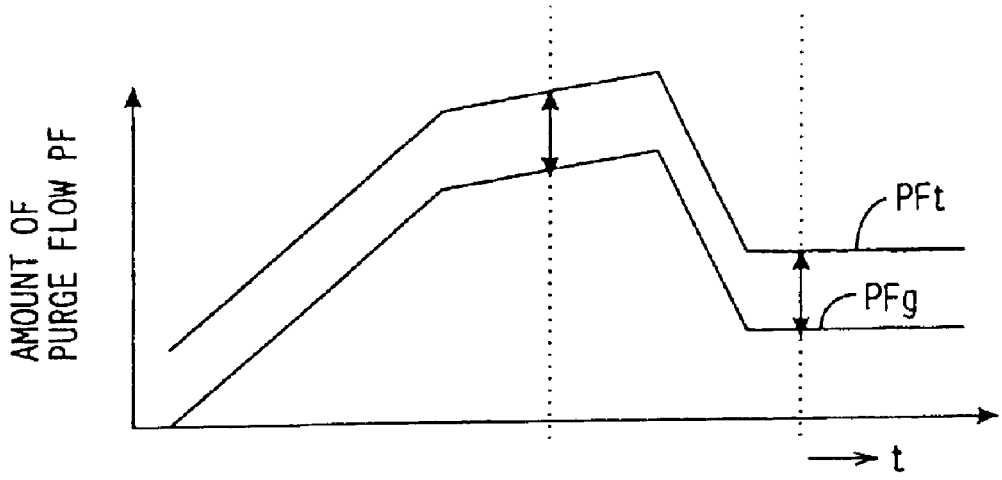
FIG. 13 is a graph showing a target amount of the purge flow and a guarded amount of the purge flow.

In the fail-safe mode described above with reference to FIG. 12, the purge flow amount PF is guarded with the fourth predetermined amount PF4. The target amount of purge flow PFt may be always guarded with a predetermined amount as shown in FIG. 13. That is, the guarded amount of purge flow PFg is set by deducting a predetermined amount from the target amount of purge flow PFt. Alternatively, the guarded amount of purge flow PFg may be set by multiplying the target amount of purge flow PFt with a predetermined factor.

Figure 14:
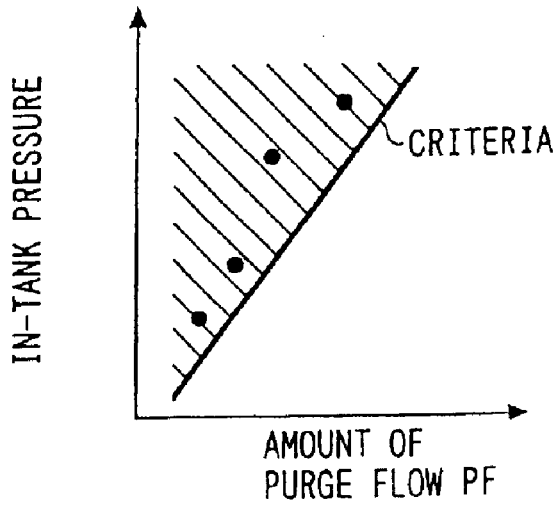
FIG. 14 is a graph showing modified criteria for determining deterioration in air permeability of the canister.
Figure 15:
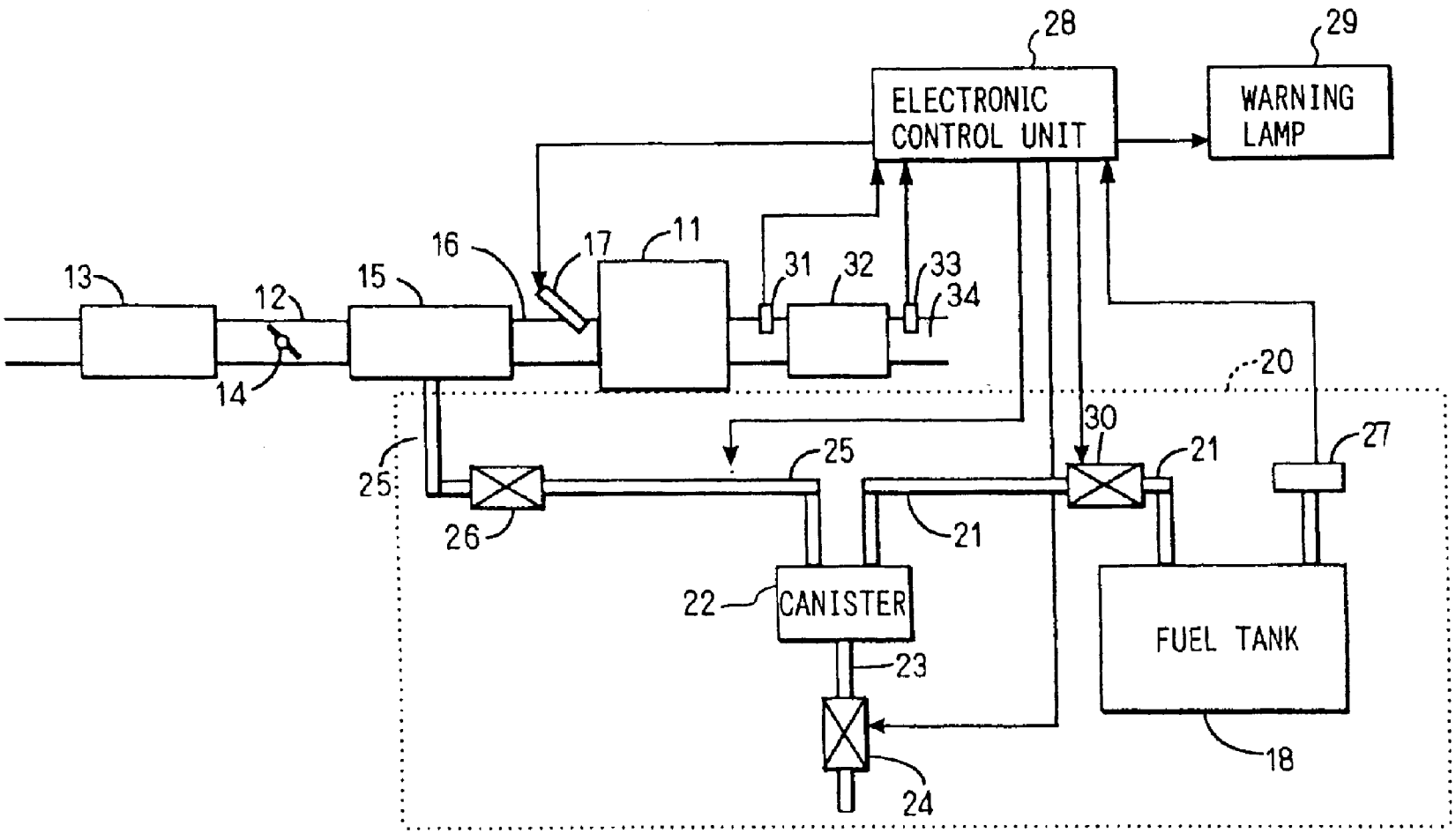
FIG. 15 is a block diagram showing a fuel evaporation control system as a second embodiment of the present invention.

The abnormal air permeability decrease in the canister 22 is detected based on two in-tank pressures Ph and Pl in the embodiment described above. A plurality of in-tank pressures (more than two) under respective amounts of purge flow may be detected instead of two. In this case, as shown in FIG. 14, the canister abnormality is determined if a certain percentage of the detected in-tank pressures exceeds a predetermined criterion line. Alternatively, it may be possible to determine the canister abnormality if all the detected in-tank pressures exceed respective criteria. It may be also possible to select two in-tank pressures detected under the purge flow amounts which are different from each other by a predetermined amount and to determine the canister abnormality based on thus selected in-tank pressures.

In the fail-safe mode described above, the amount of purge flow is controlled not to drastically change the air-fuel ratio in the purging operation. Therefore, the vapor fuel absorbed to the canister 22 can be purged into the intake pipe as long as the feedback control of the air-fuel ratio is possible, even when the air permeability in the canister is abnormally decreased. The purge control system may be modified so that the absorbed vapor fuel can be purged when the feedback control is not being performed and the air permeability in the canister is abnormally low. In this situation, the amount of purge flow is set to a low level, and the purge control is performed not to adversely affect exhaust emission.

(Second Embodiment)

A second embodiment of the present invention will be described with reference to FIGS. 15–25. First, referring to FIG. 15 an entire structure of a fuel evaporation control system will be described. This system is similar to the system shown in FIG. 1, except that a marginal current type air-fuel ratio sensor 31, a three-way catalyzer 32 and an oxygen sensor 33 are disposed in an exhaust pipe 34 of the engine 11. The air-fuel ratio sensor 31 is disposed upstream of the three-way catalyzer 32 and the oxygen sensor 33 is disposed downstream of the three-way catalyzer 32.

The three-way catalyzer 32 purifies the exhaust gas most effectively when the air-fuel ratio is controlled at a vicinity of a theoretical ratio. The air-fuel ratio detected by the air-fuel ratio sensor 31 is fed to the electronic control unit 28 which controls the air-fuel ratio in the mixture gas supplied to the engine 11 to a vicinity of the theoretical air-fuel ratio under a known feedback control. The oxygen sensor 33 disposed downstream of the three-way catalyzer 32 outputs a voltage according to an oxygen density. The output voltage of the oxygen sensor 33 is also fed to the electronic control unit 28 which adjusts a target air-fuel ratio according to the output voltages fed from the oxygen sensor 33. The fuel evaporation control system 20 is structured in the same manner as in the system shown in FIG. 1.

The electronic control unit 28 that includes a microcomputer, ROMs, RAMs and other components controls an amount of fuel injected into the engine, ignition timing and an amount of purge gas according to respective programs stored in the ROMs. Various sensors (not shown), such as a throttle sensor, an idle switch, an intake pressure sensor, a coolant temperature sensor, an intake air temperature sensor, are connected to an input circuit of the electronic control unit 28. The fuel evaporation control system 20 is also controlled by the electronic control unit 28, and a warning lamp 29 is lit to inform a driver when abnormality in the fuel evaporation control system 20 is detected.

Figure 16:
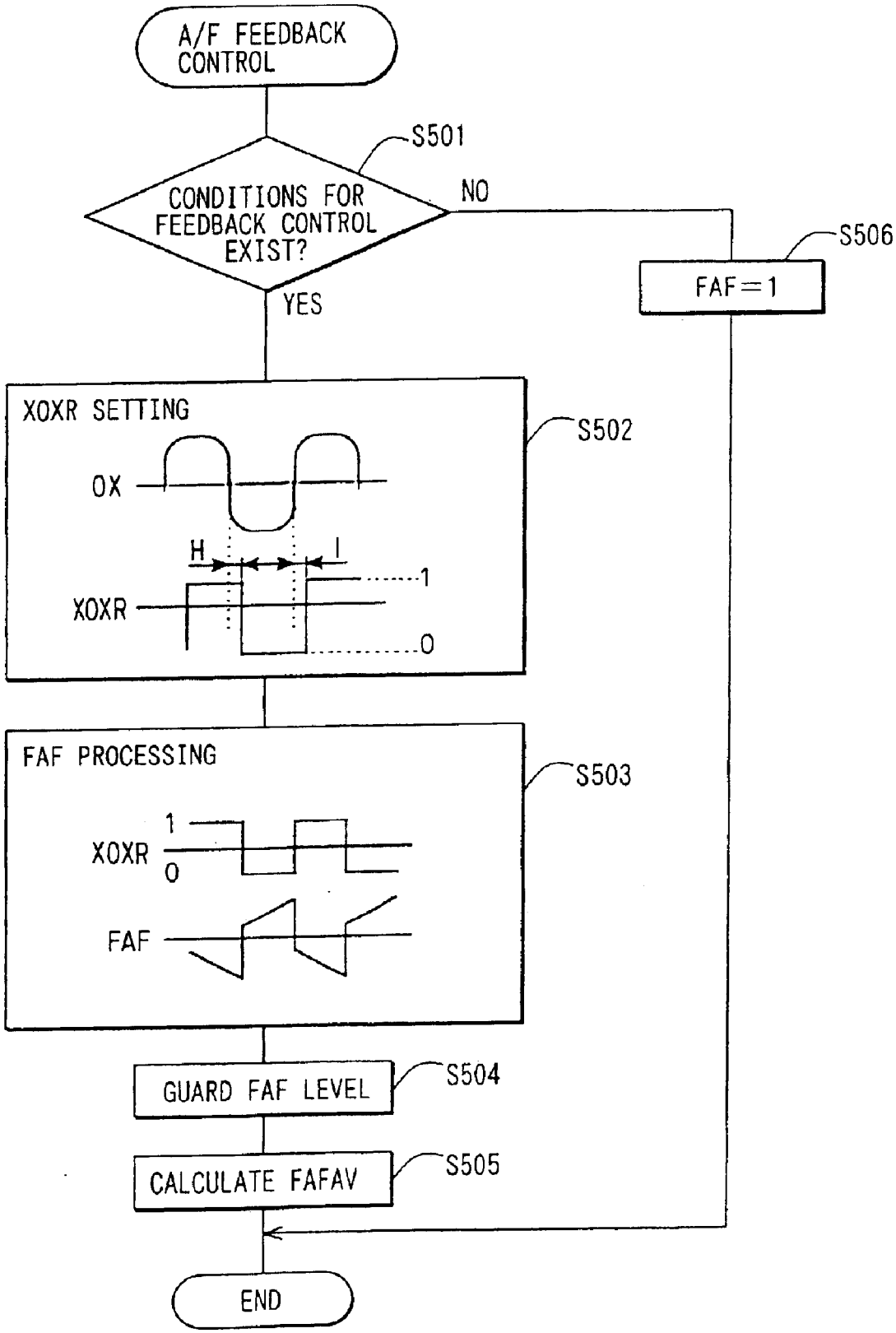
FIG. 16 is a flowchart showing a process of an air-fuel ratio feedback control.

The air-fuel ratio feedback control is performed according to a programmed process shown in FIG. 16. This process is carried out every 4-millisecond under interrupt handling. Upon starting this process, at step S501, whether conditions for performing the air-fuel ratio feedback control are satisfied is determined. The conditions are: the engine is not being cranked; fuel is not cut; coolant temperature THW is 40 degree C or higher; a fuel injection amount TAU is higher than a minimum amount TAUmin; the oxygen sensor 33 is activated; and so on. If all of those conditions are satisfied, the process proceeds to the next step S502. If any one of the conditions is not satisfied, the process proceeds to step S506, where an air-fuel ratio adjusting factor FAF is set to 1.0, and the process comes to the end.

At step S502, an air-fuel ratio flag XOXR is manipulated according to an output level OX of the oxygen sensor 33. H milliseconds after the oxygen sensor output OX has turned from fuel-rich to fuel-lean, the flag XOXR is set to 0 (XOXR=0, that denotes fuel-lean). L milliseconds after the oxygen sensor output OX has turned from fuel-lean to fuel-rich, the flag XOXR is set to 1 (XOXR=1, that denotes fuel-rich). Then, the process proceeds to step S503, where the air-fuel ratio adjusting factor FAF is controlled based on the flag XOXR. When the flag XOXR turns from 0 to 1, or vice versa, the level of FAF is shifted by a predetermined value. During a period in which the flag XOXR stays at 0 or 1, the value of FAF is integrated. Then, the process proceeds to step S504, where the upper and the lower limit of FAF are checked (a guarding process). At the next step S505, the FAF value is adjusted to eliminate abrupt changes (rounding process) every time it is shifted or every predetermined period of time, thereby obtaining a rounded air-fuel ratio adjusting factor FAFAV. Then, the process comes to the end.

Figure 17:
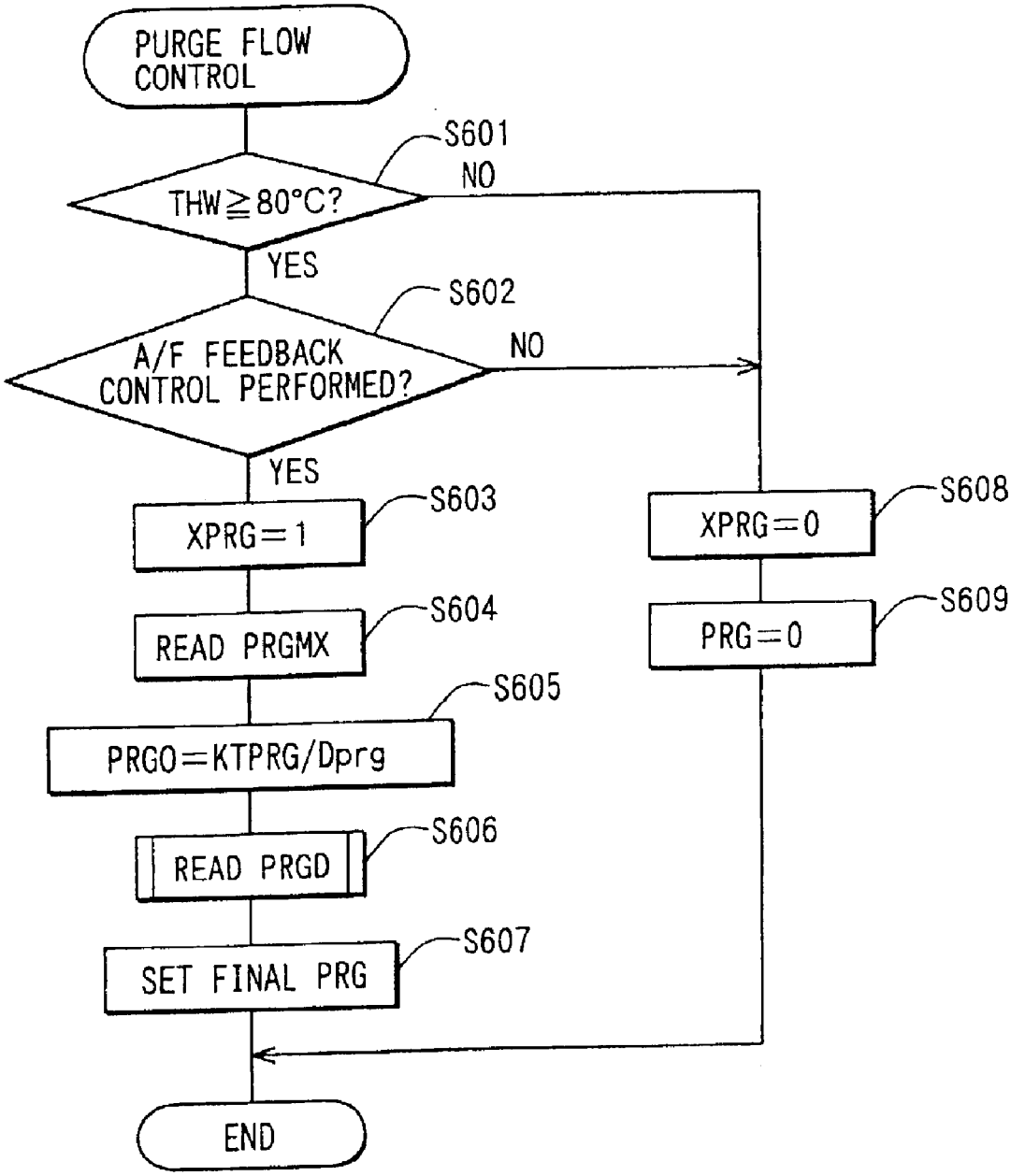
FIG. 17 is a flowchart showing a process of controlling an amount of the purge flow.

A process of controlling the amount of purge flow is shown in FIG. 17. This process is carried out by interrupt handling of, e.g., every 32 milliseconds. The amount of purge flow means a ratio of an amount of air supplied through the fuel evaporation control system 20 to the intake pipe of the engine relative to an amount of air supplied to the engine from outside. Upon starting the process, at step S601, whether the coolant temperature THW is 80° C. or higher is determined. Then, at step 602, whether the air-fuel ratio feedback control is being performed is determined. If the determinations of both steps S601 and S602 are affirmative, the process proceeds to step S603, where a flag XPRG indicating to perform the purge control is set (XPRG=1).

Then, at steps S604–S607, a final amount of purge flow PRG is calculated in the following manner. At step S604, a maximum amount of purge flow PRGMX (an amount of purge flow obtained when the purge control valve 26 is fully open) is read out from a map shown in FIG. 21. PRGMX is determined according to an intake pipe pressure PM and an engine speed Ne. At the next step S605, a target amount of purge flow PRGO is calculated according to the formula: PRGO=KTPRG/Dprg, where KTPRG is a target amount of TAU adjustment, and Dprg is a learned purge gas density. KTPRG is the maximum amount to adjust the amount of fuel injection TAU, i.e., KTPRG is deducted from TAU in the maximum adjustment of TAU. The leaned purge gas density Dprg corresponds to an amount of evaporated fuel absorbed to the canister 22, and it is estimated in a process explained later, renewed from time to time and stored in the RAM in the electronic control unit 28. Accordingly, the target amount of purge flow PRGO represents an amount of purge flow to be supplied to the intake pipe when the amount of fuel injection TAU is reduced by the maximum amount. The target amount of purge flow PRGO becomes smaller as the learned purge density Dprg becomes higher under the same driving conditions of the engine. In this particular embodiment, KTPRG is set to 30% of TAU.

Then, at the next step S606, an adjusted amount of purge flow PRGD is read out. PRGD is an amount calculated in the process shown in FIG. 18, which will be explained later, to avoid disturbance in the air-fuel ratio feedback control due to an abrupt change of the amount of purge flow. After the maximum amount of purge flow PRGMX, the target amount of purge flow PRGO and the adjusted amount of purge flow PRGD have been obtained in the manner described above, the process proceeds to step S607, where a lowest amount among those three (PRGMX, PRGO and PRGD) is selected and set as the final amount of purge flow PRG. The purge control is performed using the final amount of purge flow PRG. Usually, PRG corresponds to PRGD, but PRG is switched to PRGMX or to PRGO if PRGD continues to increase during the purge control. The maximum level of purge flow is limited to the level of PRGMX or PRGO. In other words, an actual amount of purge flow is guarded by PRGMX or PRGO.

On the other hand, if the coolant temperature THW is lower than 80° C. (S601), or if the air-fuel ratio feedback control is not being performed (S606), the process proceeds to step S608, where the purge flag XPRG is reset (XPRG=0). Then, the final amount of purge flow PRG is set to 0 at the next step S609, and the process comes to the end. The fact that the PRG is set to 0 means that the vaporized fuel is not purged into the intake pipe of the engine. When the coolant temperature THW is lower than 80° C., an amount of fuel injection is increased, and therefore the purge gas is not supplied to the engine.

Figure 18:
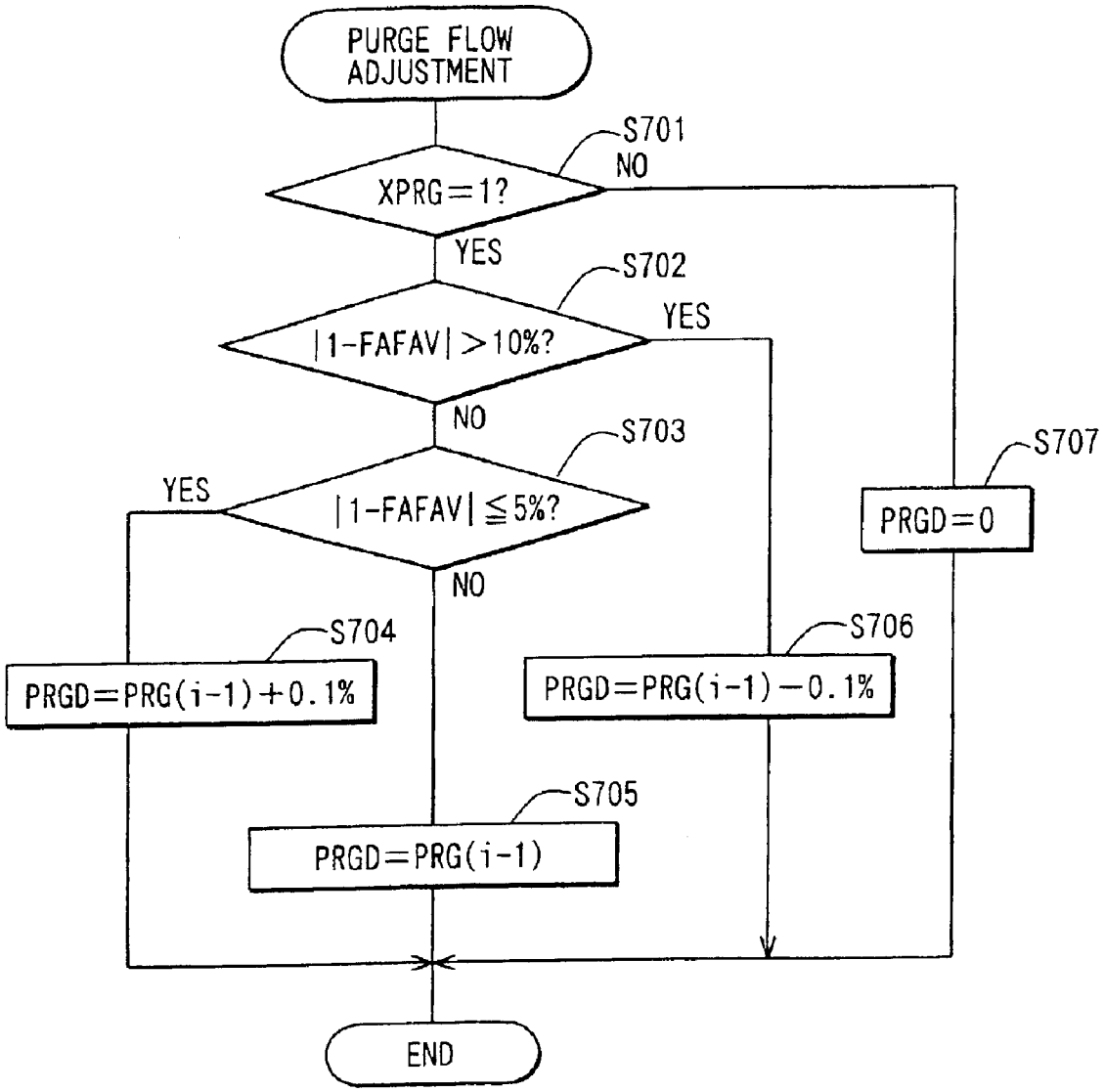
FIG. 18 is a flowchart showing a process for gradually changing an amount of the purge flow.

A process of adjusting the amount of purge flow will be described with reference to the flowchart shown in FIG. 18. In this process, the amount of purge flow is adjusted to avoid an abrupt change of the purge flow amount. At step S701, whether the purge flag XPRG is set or not is checked. If it is not set (XPRG=0), i.e., gas purging is not carried out, the process proceeds to step S707, where the adjusted amount of purge flow PRGD is set to zero, and then the process comes to the end. If the flag XPRG is set (XPRG=1), the process proceeds to step S702, where a deviation of the air-fuel ratio adjusting factor FAF, i.e., $|1-FAF|$ is calculated, and whether the deviation is higher than 10% is determined.

If the adjusting factor deviation is higher than 10%, the process proceeds to step S706, where the adjusted amount of purge flow PRGD is calculated according to the formula: PRGD=PRG(i−1)−0.1%, where PRG(i−1) is a previously set final amount of purge flow. If it is determined that the adjusting factor deviation $|1-FAF|$ is not higher than 10% at step S702, the process proceeds to step S703, where whether the adjusting factor deviation is equal to or lower than 5% is determined. If the determination at step S703 is affirmative, the process proceeds to step S704, where the adjusted amount of purge flow PRGD is calculated according to the formula: PRGD=PRG(i−1)+0.1%. If the determination at step S703 is negative, i.e., $5\% < |1-FAF| \leqq 10\%$, the process proceeds to step S705, where the adjusted amount of purge flow PRGD is set to the previously set amount of purge flow PRG(i−1).

Figure 19:
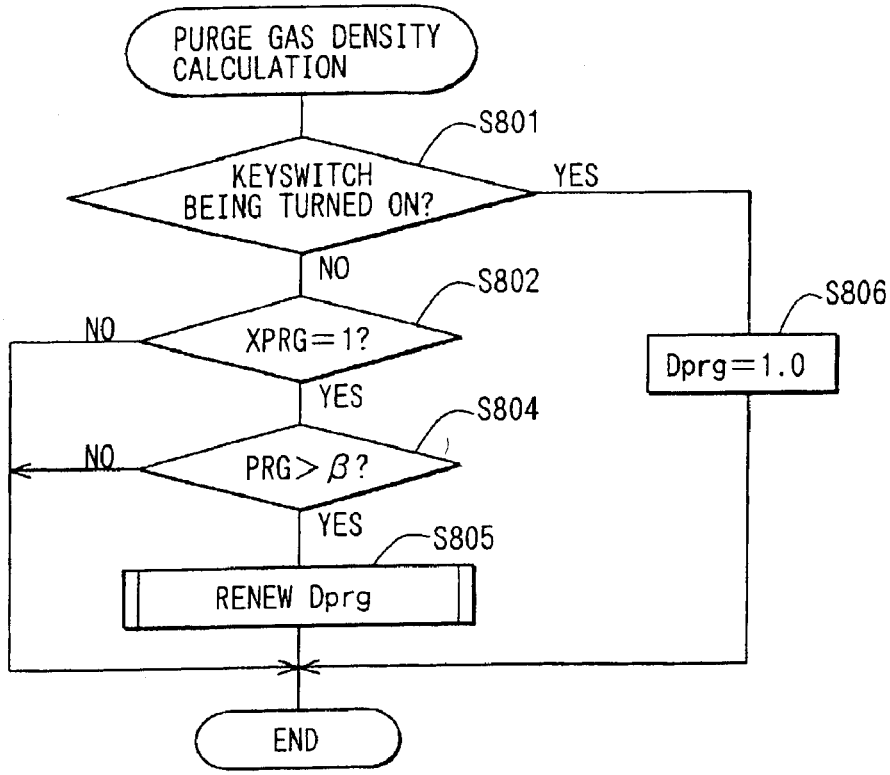
FIG. 19 is a flowchart showing a process of learning a purge gas density.

A process of setting the leaned amount of purge gas density Dprg will be described with reference to FIG. 19. This process is carried out every 4 milliseconds by interrupt handling. At step S801, whether a key switch is being turned on is checked. If the key switch is being turned on (during a cranking period), the process proceeds to step S806, where all data are initialized and the learned amount of purge gas density Dprg is reset to 1.0 (Dprg=1.0; this means that the purge gas density is zero, i.e., no evaporated fuel is absorbed to the canister 22). During the cranking period, it is presumed that no gas is absorbed to the canister.

After the cranking period, the process proceeds to step S802, where the purge control is being performed or not is determined (XPRG=1 means that the purge control is being performed). If the purge control is not being performed (XPRG=0), the process proceeds to the end of the routine. If the purge control is being performed, the process proceeds to step S804, where the final amount of purge flow PRG is higher than β % is determined. The reason for performing this step here is to check whether an opening degree of the purge control valve 26 is too small. If the opening degree is too small, the purge gas density may not be correctly detected because the purge control may not be accurately carried out. If the final amount of purge flow is lower than β %, the process comes to the end. If it is higher than β %, the process proceeds to step S805, where the learned purge gas density Dprg is renewed. This step will be explained later with reference to FIG. 20.

Generally, the amount of fuel injection TAU is controlled to attain a target air-fuel ratio. Since the fuel contained in the purge flow is added to the fuel injected to the engine, TAU has to be controlled taking into consideration the amount of fuel contained in the purge flow. To obtain a correct amount of the fuel contained in the purge flow, it is important to correctly determine the purge gas density. The purge gas density is obtained through a computer process as the learned purge gas density Dprg. If Dprg is not accurate, the air-fuel ratio is not controlled to the target ratio. The deviation of the air-fuel ratio from the target deviates the air-fuel ratio adjusting factor FAF. Therefore, a deviation of the leaned purge gas density Dprg from a correct density can be detected by monitoring the FAF deviation. In the process shown in FIG. 20, the leaned purge gas density Dprg is continuously renewed by monitoring the deviation of smoothed value of the air-fuel ratio adjusting factor FAFAV.

Figure 20:
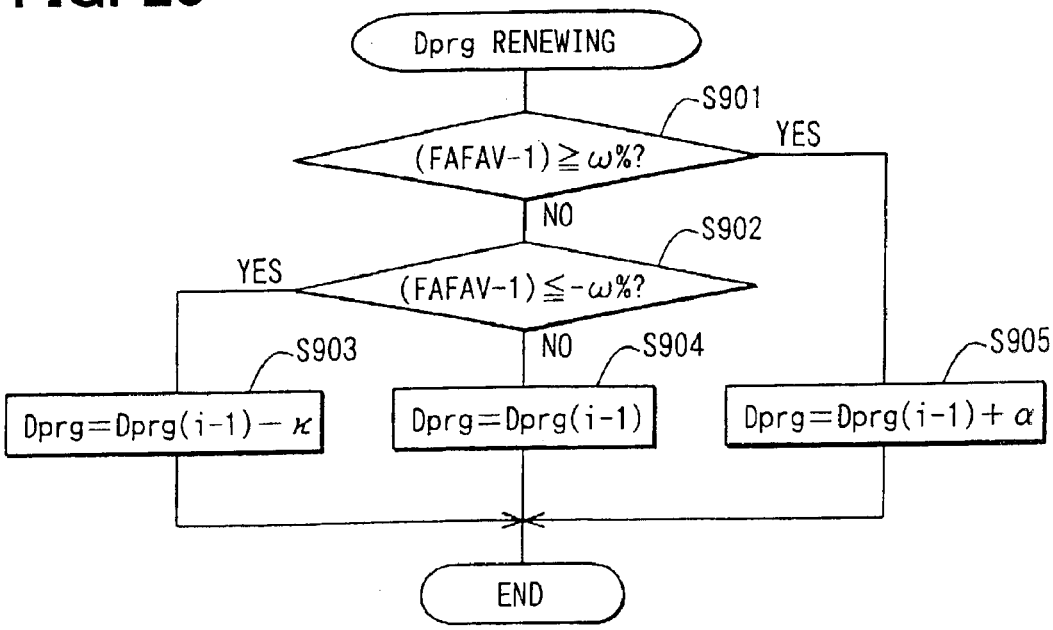
FIG. 20 is a flowchart showing a process of renewing a leaned purge gas density.
Figure 21:
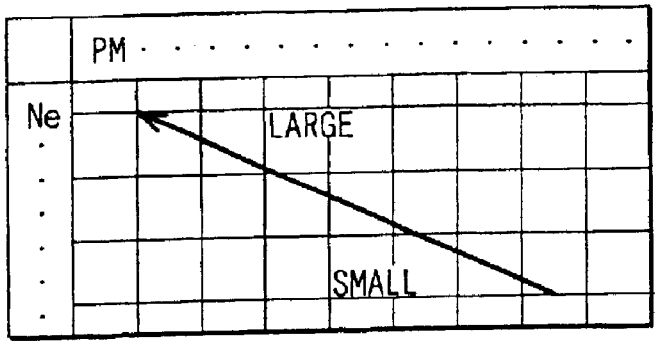
FIG. 21 is a map showing a maximum amount of the purge flow determined according to an amount of intake air and a rotational speed of an engine.

Now, referring to FIG. 20, the process of renewing the learned purge gas density Dprg will be described. At step S901, a deviation of the smoothed value of the adjusting factor FAFAV from a standard level (which is 1 as explained above) is compared with a predetermined value ω (e.g., 2%). That is, whether (FAFAV−1) is equal to or larger than ω is determined at step S901. If the determination at step S901 is affirmative, the process proceeds to step S905, where a present Dprg is calculated according to the formula: Dprg=Dprg(i−1)+α, where Dprg(i−1) is a previous Dprg, and α is a predetermined value. If the present Dprg is set to a level lower than an actual level, a total amount of fuel becomes short to attain the target air-fuel ratio, and combustion in the engine is performed at a fuel-lean side. Accordingly, to adjust the air-fuel ratio to a correct level, FAF is set to a higher level than the standard level 1. The fact that (FAFAV−1) is equal to or higher than ω means that Dprg is lower than an actual purge gas density. Therefore, the predetermined value α is added to the previous Dprg to renew Dprg at step S905.

On the other hand, if it is determined that (FAFAV−1) is lower than ω % at step S901, the process proceeds to step S902, where (FAFAV−1) is equal to or lower than −ω % is determined. If the determination at step S902 is affirmative, the process proceeds to step S903, where a present Dprg is calculated according to the formula: Dprg=Dprg(i−1)−κ, where κ is a predetermined value. This is just opposite to the adjustment done at step S905. Dprg is adjusted to a lower level, because it has been set to a level higher than an actual level. If the determination at step S902 is negative, i.e., if FAFAV is within a range (1±ω %), the process proceeds to step S904, where the present Dprg is kept at the level of the previous one without renewing it. In this case, it is not necessary to renew the learned gas density Dprg because the FAFAV deviation from the standard level 1 is small. After completing steps S903, S904 and S905, this process comes to the end.

As described above, the learned purge gas density Dprg is continuously renewed based on the level of the air-fuel ratio. The initial level of Dprg is set to 1.0, i.e., Dprg is 1.0 when no gas is absorbed to the canister 22. As the purge gas density becomes higher (as the amount of fuel absorbed to the canister becomes larger), the level of Dprg is decreased from the initial level 1.0. As the purge gas density becomes lower, the level of Dprg is increased from the initial level 1.0. Since the accuracy of Dprg is not high enough when the opening degree of the purge control valve 26 is small, as explained in connection with the process shown in FIG. 19, the level of β at step S804 may be set to a level of 2% in order to detect the purge gas density only when it is accurately detected.

Figure 22:
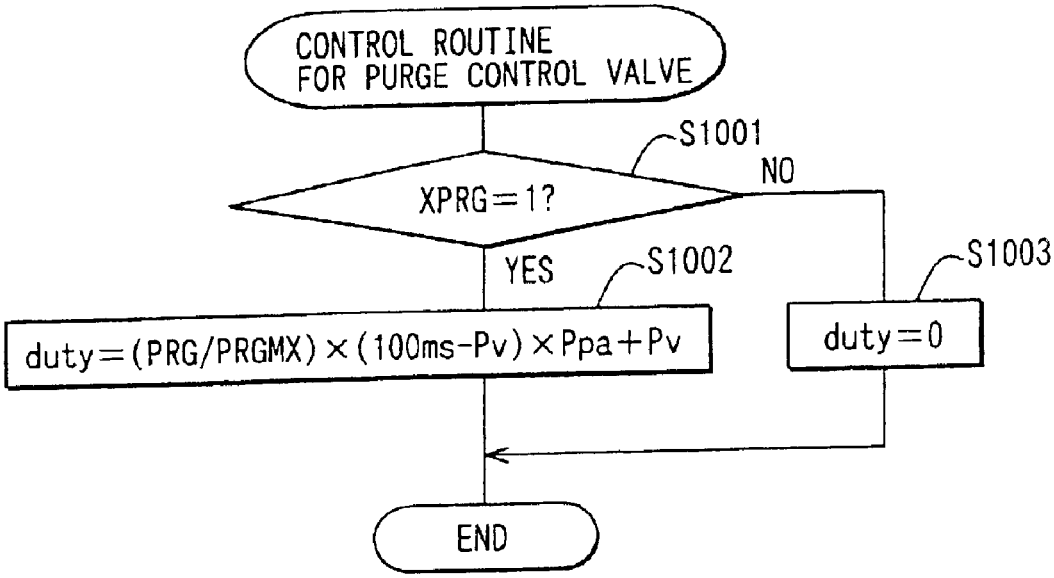
FIG. 22 is a flowchart showing a process of controlling a purge control valve.

A process of controlling the purge control valve 26 will be described with reference to FIG. 22. This process is carried out every 100 millisecond by interrupt handling. At step S1001, whether the purge flag XPRG is set (XPRG=1) or not (XPRG=0) is checked. If the purge flag XPRG is not set, the process proceeds to step S1003, where a duty ratio for opening the purge control valve 26 is set zero. If the purge flag is set, the process proceeds to step S1002, where the duty ratio for opening the purge control valve 26 is calculated according to the formula: the duty ratio=(PRG/PRGMX)×(100 msec−Pv)×Ppa+Pv, where Pv is a time period for adjusting the driving period of 100 msec according to a power source voltage, and Ppa is a factor for adjusting atmospheric pressure changes. The purge control valve 26 is driven under the duty ratio calculated as above.

Now, referring to FIG. 23, a process of detecting canister deterioration will be described. In this process, whether the canister ability, or capacity, to absorb fuel vapor thereto is deteriorated or not is detected. If the fuel-absorbing ability of the canister is deteriorated, fuel evaporated from the fuel tank 18 cannot be sufficiently absorbed by the canister 22. If the deterioration occurs, the purge gas density decreases more quickly than in a normal canister in the purging process, because the amount of fuel absorbed by the canister 22 is small. In this process, a period of time in which the purge gas density decreases is detected, and the deterioration of the fuel-absorbing ability is determined based on the detected period.

At step S1101, whether conditions for detecting the canister abnormality (an abnormal decrease in the absorbing ability) are satisfied is determined. The conditions include: the sensors and the systems relating to this detection are normally functioning; other diagnoses affecting this detection process are not being carried out; and the purge gas density is within a predetermined range. The sensors and systems relating to this detection process include: the air-fuel ratio sensor 31, the purge control valve 26, the tank-cut valve 30, the pressure sensor 27, and other sensors not shown in FIG. 15, such as a coolant temperature sensor, an intake air temperature sensor, an intake pipe pressure sensor, an engine rotational speed sensor, a sensor for measuring a fuel amount remaining in the fuel tank 18. Other diagnoses affecting this detection process include a diagnosis for checking operation of the purge control valve 26 and a diagnosis of leakage in the fuel evaporation control system. Whether the purge gas density is within a predetermined range is determined based on combination of all or some of information regarding coolant temperature, intake air temperature, in-tank pressure, the learned purge gas density Dprg, fuel temperature, engine oil temperature, ambient temperature.

If those conditions are not satisfied (step S1101), the process proceeds to step S1102, where an integrated value Dprg(ad) of Dprg (explained later) is reset, and then the process comes to the end. The reason why Dprg(ad) is reset here is to avoid misjudgment of the canister abnormality. If the abnormality detection is performed when those conditions are not satisfied, the amount of fuel absorbed to the canister may fluctuate, which leads to misjudgment. If those conditions are satisfied (step S1101), the process proceeds to step S1103, where whether the purge flag XPRG is set or not is checked. If the purge flag is not set (XPRG=0), the process directly comes to the end. If the purge flag is set (XPRG=1), the process proceeds to step S1104, where the learned purge gas density Dprg is read out form the RAM in the electronic control unit 28. Then, at step S1105, whether the present level of Dprg is higher than the maximum level Dprg(max) that has ever appeared is determined.

If Dprg is higher than Dprg(max), the process proceeds to step S1106, where Dprg(max) is replaced with the present Dprg, and then the process proceeds to step S1107. If it is determined that Dprg is lower than Dprg(max) at step 1105, the process directly proceeds to step S1107. At step S1107, a present integrated purge gas density Dprg(ad) (i) is calculated according to the formula: Dprg(ad) (i)=Dprg(ad) (i−1)+Dprg(i), where (i) indicates a present level and (i−1) indicates an immediately previous level. Dprg(ad) is not accumulated during a period in which the purge control is not performed (XPRG=0), because a state of fuel absorption in the canister does not substantially change during this period. Accordingly, Dprg(ad) functions as a time counter for detecting the canister abnormality.

At the next step S1108, whether the integrated value Dprg(ad) exceeds a predetermined level PDprg(ad) is determined. The predetermined PDprg(ad) is preset to such a level which is attained during the purging process without decreasing the purge gas density if the canister absorbing ability is normal. In other words, if Dprg(ad) becomes the level of PDprg(ad) during the purging process, the fuel absorbing ability of the canister can be determined as normal. Therefore, if it is determined that Dprg(ad) is higher than PDprg(ad), the process proceeds to step S1111, where it is determined that the canister absorbing ability is normal.

Figure 24:
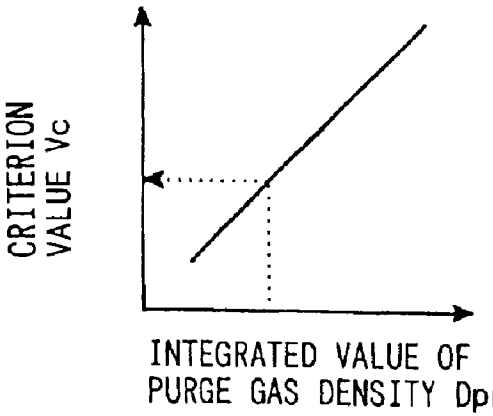
FIG. 24 is a graph showing a criterion value determined according to an integrated value of the purge gas density.

If it is determined that Dprg(ad) is lower than PDprg(ad) at step S1108, the process proceeds to step S1109, where a difference between Dprg(max), which is renewed at step S1106, and the present Dprg, which is read out at step S1104, is compared with a criterion value Vc. The criterion value Vc may be set in relation to the level of Dprg(ad) as shown in FIG. 24. The criterion value Vc is set to a lager value as the integrated purge gas density Dprg(ad) becomes higher. If the difference between Dprg(max) and Dprg is smaller than the criterion value Vc, the decrease in the absorbing ability of the canister cannot be judged because the fuel absorbed by the canister is still being purged. Accordingly, the process comes to the end in this case. On the other hand, if the difference between Dprg(max) and Dprg is larger than the criterion value Vc, it is determined that the fuel-absorbing ability of the canister is abnormally low, because the present purge gas density Dprg is substantially lower than the maximum density Dprg(max) while the accumulated value Dprg(ad) has not yet reached the predetermined level PDprg (ad). Accordingly, the process proceeds to step S1110, where it is determined that the canister is abnormal. Then, the process comes to the end.

Figure 25:
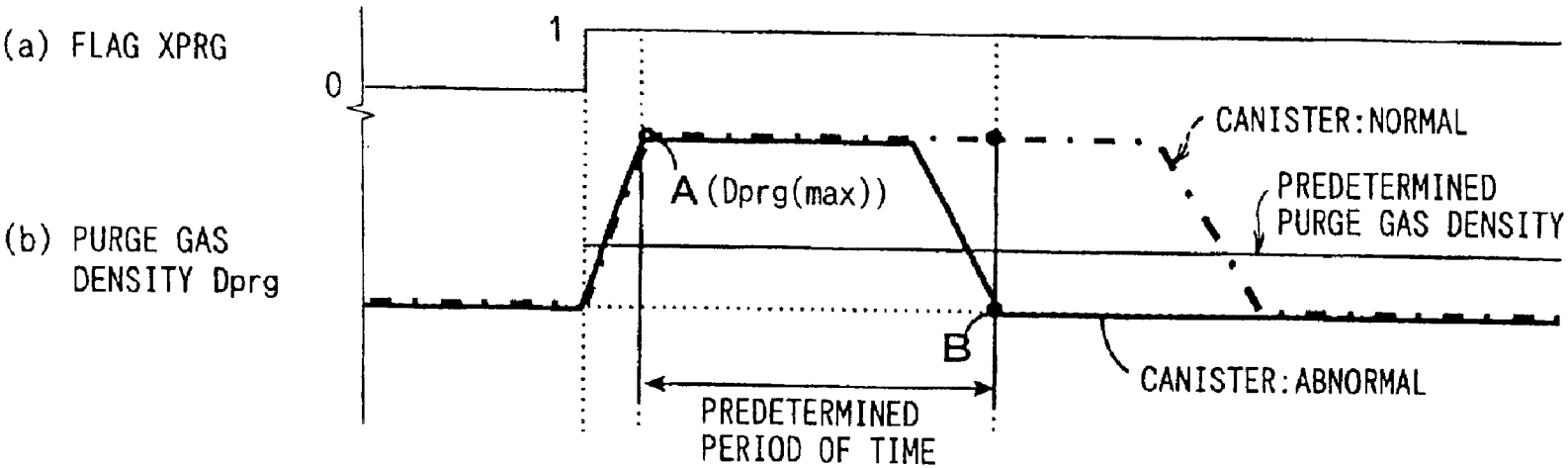
FIG. 25 is a timing chart showing a sequence of the process shown in FIG. 23.

Referring to FIG. 25, timing in the process for detecting the fuel-absorbing ability of the canister described above will be explained. Whether the purge flag XPRG is 1 or 0 is shown in graph (a), and the learned purge gas density Dprg is shown in graph (b) In graph (b), a solid line shows the learned purge gas density Dprg in case the canister is abnormal, and a dotted line shows the same in case the canister is normal. Upon setting the purge flag at time $t_0$, detection of Dprg starts. Thereafter, Dprg is continuously renewed until time $t_2$, and Dprg reaches the maximum level Dprg(max) (at point A). Dprg starts to decrease at a certain time after t1. If Dprg decreases to a abnormally low level (point B) at time $t_2$ when a predetermined time period has lapsed from time $t_1$, it is determined that the fuel-absorbing ability of the canister is abnormally low, as shown by the solid line. If Dprg is still high at time $t_2$, as shown by the dotted line, it is determined that the canister is normal because the canister sufficiently absorbs evaporated fuel and the absorbed fuel is purged, keeping its density at a high level.

Figure 23:
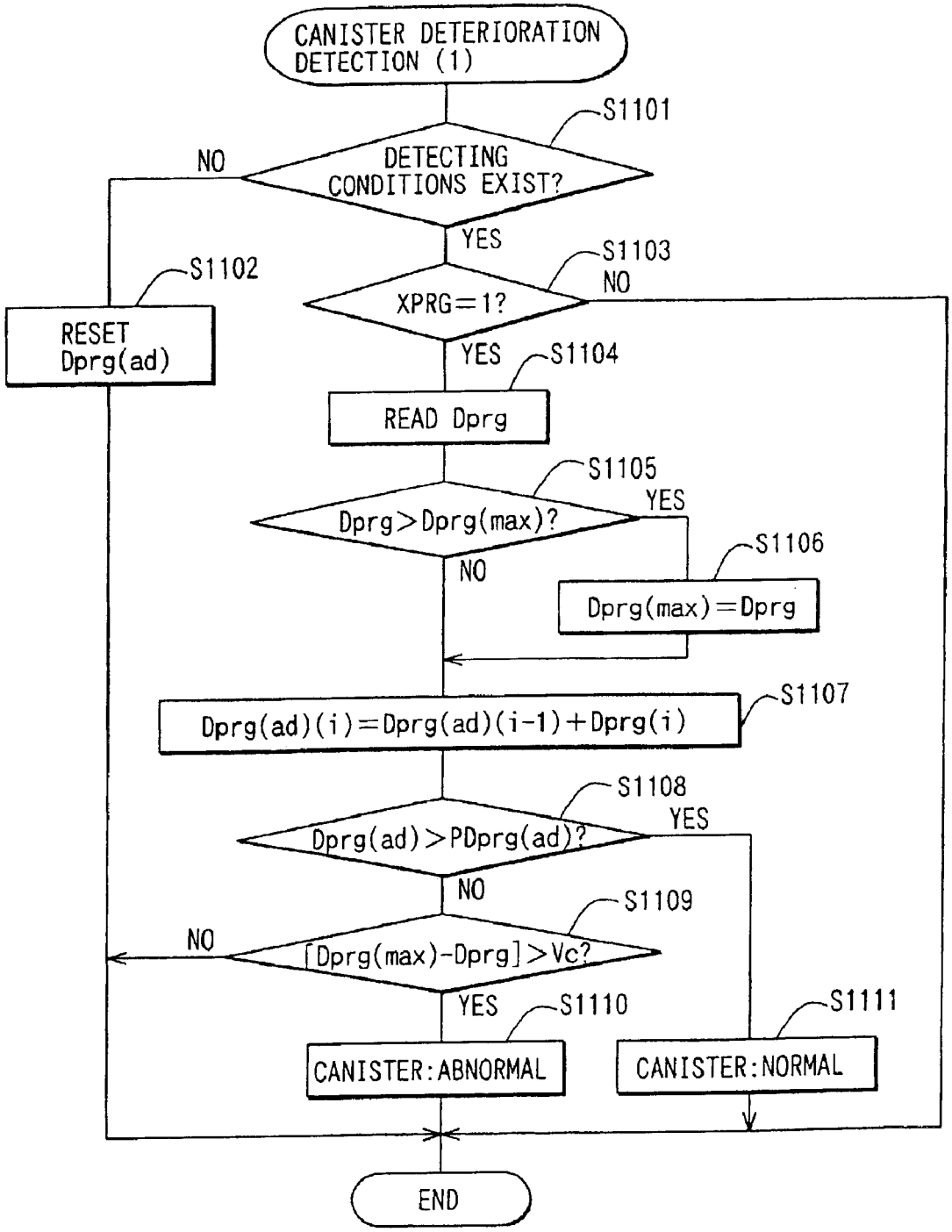
FIG. 23 is a flowchart showing a process of detecting deterioration of the canister.

The Dprg(ad) obtained by integrating Dprg from the beginning of the purge control may be used as the predetermined time period between point A and point B, as done in the process shown in FIG. 23. Alternatively, the predetermined time may be counted from a time when the engine is started. In the timing chart shown in FIG. 25, the predetermine period of time is counted from the time when Dprg(max) is detected.

Thus, the fuel absorbing ability of the canister 22 is detected based on the learned purge gas density Dprg. Dprg is continuously renewed by monitoring the factor FAF for adjusting the air-fuel ratio and is compared with a maximum purge gas density Dprg(max) appeared in the purge control process. If Dprg becomes to a level lower than the Dprg (max) by a predetermined value Vc within a predetermined time period, then it is determined that the fuel-absorbing ability of the canister is abnormally low.

(Third Embodiment)

A third embodiment of the present invention will be described with reference to FIGS. 26–29. In this embodiment, the decrease in the air permeability of the canister 22 is detected based on the learned purge gas density Dprg. The learned purge gas density Dprg is detected in two ranges of the amount of purge gas flow PRG. The leaned purge gas density Dprg is continuously renewed based on the air-fuel ratio adjusting factor FAF in the same manner as in the second embodiment.

A process for detecting the air-permeability decrease in the canister 22 based on the learned purge gas density Dprg will be described with reference to the flowchart shown in FIG. 26. At step S1101, whether detecting conditions are satisfied or not is determined. Since this step is the same as that explained in connection with FIG. 23, the details are not repeated here. If the conditions are not satisfied, the process proceeds to step S1102, where the integrated value of the purge gas density Dprg(ad) and flags Fref1, Fref2 for performing air-permeability detection are reset, or cleared, and then the process comes to the end. If the detecting conditions are satisfied, the process proceeds to step S1103, where whether the purge flag XPRG is set is checked. If the purge flag is not set, the process directly proceeds to the end.

If the purge flag XPRG is set at step S1103, i.e., if the purge control is being performed, the process proceeds to the flowing steps. At step S1204, the amount of purge flow PRG at present is read out from the electronic control unit 28. At step S1205, the learned purge gas density Dprg is read out form the electronic control unit 28. At step S1206, the integrated value of the purge gas density Dprg(ad) is calculated according to the formula: Dprg(ad)=Dprg(ad) (i−1)+Dprg(i), in the same manner as in step S1107 of the second embodiment. Then, at step S1207, whether the amount of purge flow PRG is within a predetermined range R1. If the amount of purge gas flow PRG is within range R1, the process proceeds to step S1208, where whether the present Dprg is higher than a first minimum purge gas density Dprg(min1) is determined. If Dprg is higher than Dprg (min1), the process proceeds directly to step S1210. If not, the process proceeds to step S1209, where Dprg(min1) is renewed to the present Dprg level.

At step S1210, whether a predetermined time period PT1 has lapsed, counting from the time when the amount of purge flow PRG is set within the range R1, is determined. This is because the predetermined time period PT1 is necessary to obtain a stabilized purge gas density. If the time period PT1 has not lapsed, the process directly proceeds to the end through step S1212. If the time period PT1 has lapsed, the process proceeds to step S1211, where a flag Fref1 indicating to perform a detection routine (explained later) is set. Then the process comes to the end through step S1212.

On the other hand, if it is determined that the amount of purge flow PRG is not within range R1 at step S1207, the process proceeds to step S1213, where whether the amount of purge flow PRG is within another range R2 is determined. If not, the process proceeds to the end through step S1212. If the amount of purge flow PRG is within range R2, the process proceeds to step S1214, where whether the presently set Dprg is higher than a second minimum purge gas density Dprg(min2) is determined. If Dprg is not higher than Dprg (min2), the process proceeds to step S1215, where Dprg (min2) is renewed to the level of Dprg. If Dprg is higher than Dprg(min2), the process proceeds to step S1216 because there in no need to renew the Dprg(min2). At step S1216, whether a predetermined time period PT2 has lapsed, counting from the time when the amount of purge flow PRG is set in range R2. If the time period PT2 has lapsed, the process proceeds to step S1217, where a flag Fref2 indicating to perform the detection routine (explained later) is set, and then the process comes to the end through step S1212. If the time period PT2 has not lapsed, the process proceeds to the end through step S1212.

Figure 27:
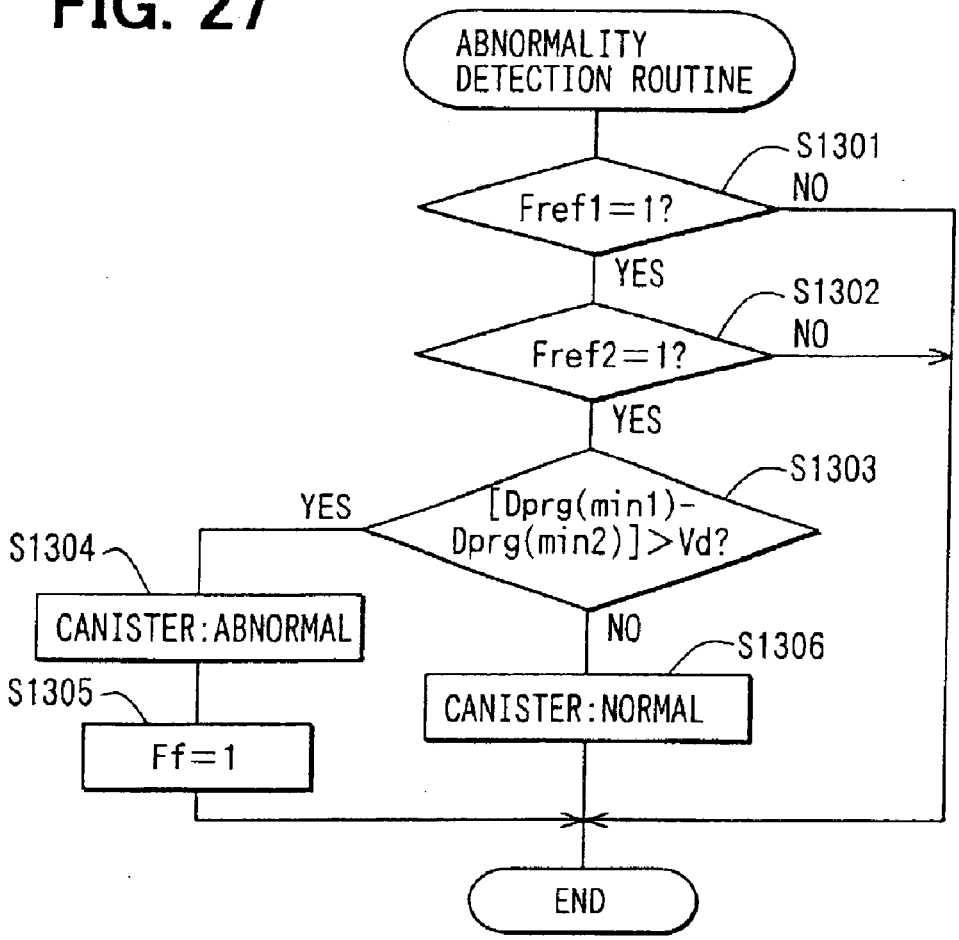
FIG. 27 is a flow chart showing details of the abnormality detection performed in the process shown in FIG. 26.

Now, a process of detecting the air permeability decrease in the canister 22 will be described with reference to FIG. 27. In this process, the air permeability decrease is detected based on the learned purge gas density Dprg obtained under two ranges R1, R2 of the amount of purge flow PRG. At step S1301, whether the flag Fref1 is set or not is checked. At step S1302, whether another flag Fref2 is set or not is checked. If both flags are set, the process proceeds to following steps to detect the canister abnormality (the air permeability decrease). If either one of the flags or both flags are not set, the process comes to the end.

Figure 26:
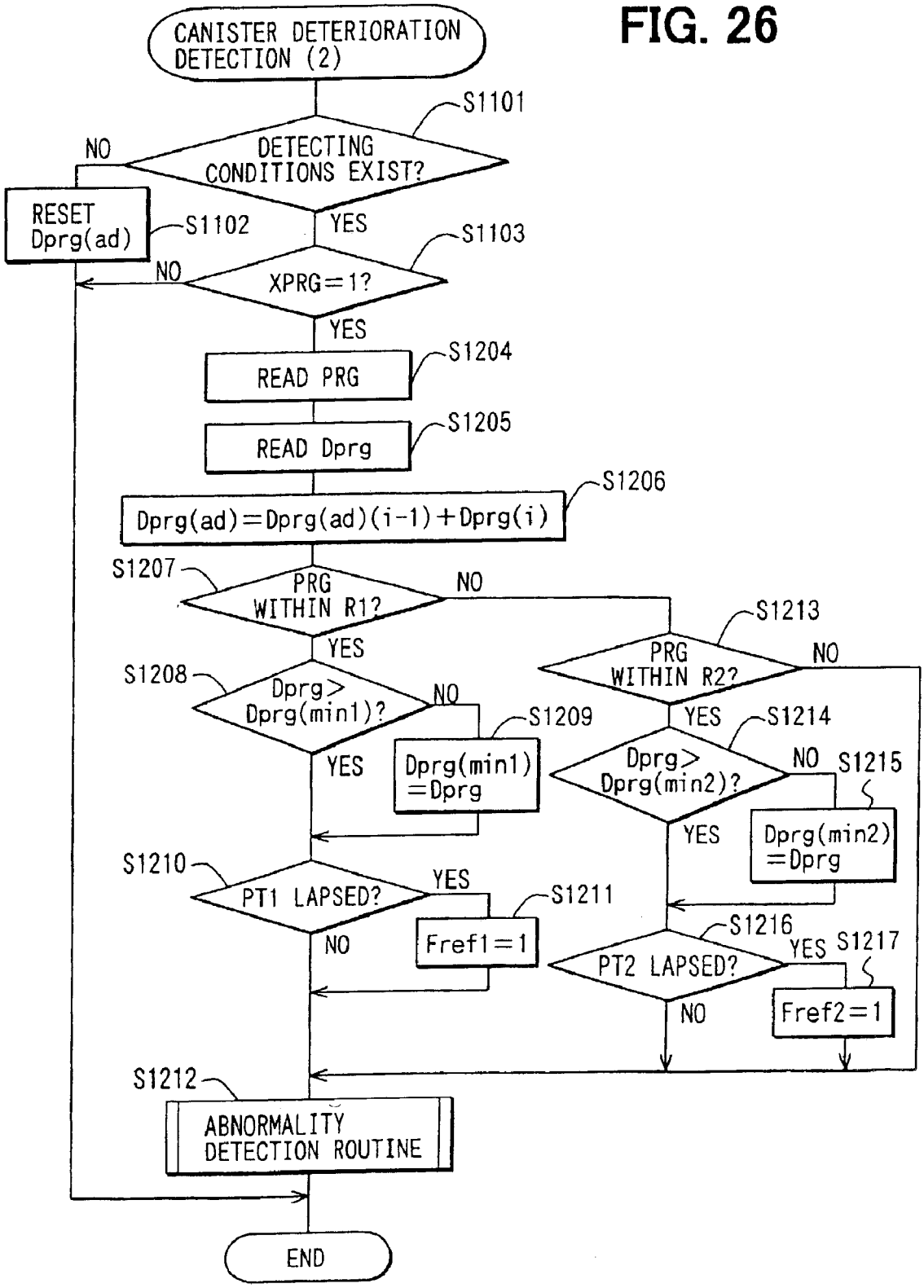
FIG. 26 is a flowchart showing a process of detecting abnormality in the canister, as a third embodiment of the present invention.

At step S1303, a difference between Dprg(min1) and Dprg(min2), both set in the process shown in FIG. 26, is calculated, and the difference is compared with a criterion value Vd. If the difference is smaller than Vd, the process proceeds to step S1304, where it is determined that the canister is normal. Then, the process comes to the end. If the difference between Dprg(min1) and Dprg(min2) is larger than the criterion value Vd, the process proceeds to step S1304, where it is determined that the canister is abnormal, and then to step S1305, where the flag Ff is set. Then, the process comes to the end. When the flag Ff is set, the fial-safe mode process shown in FIG. 12 and explained in the first embodiment may be performed.

Figure 29:
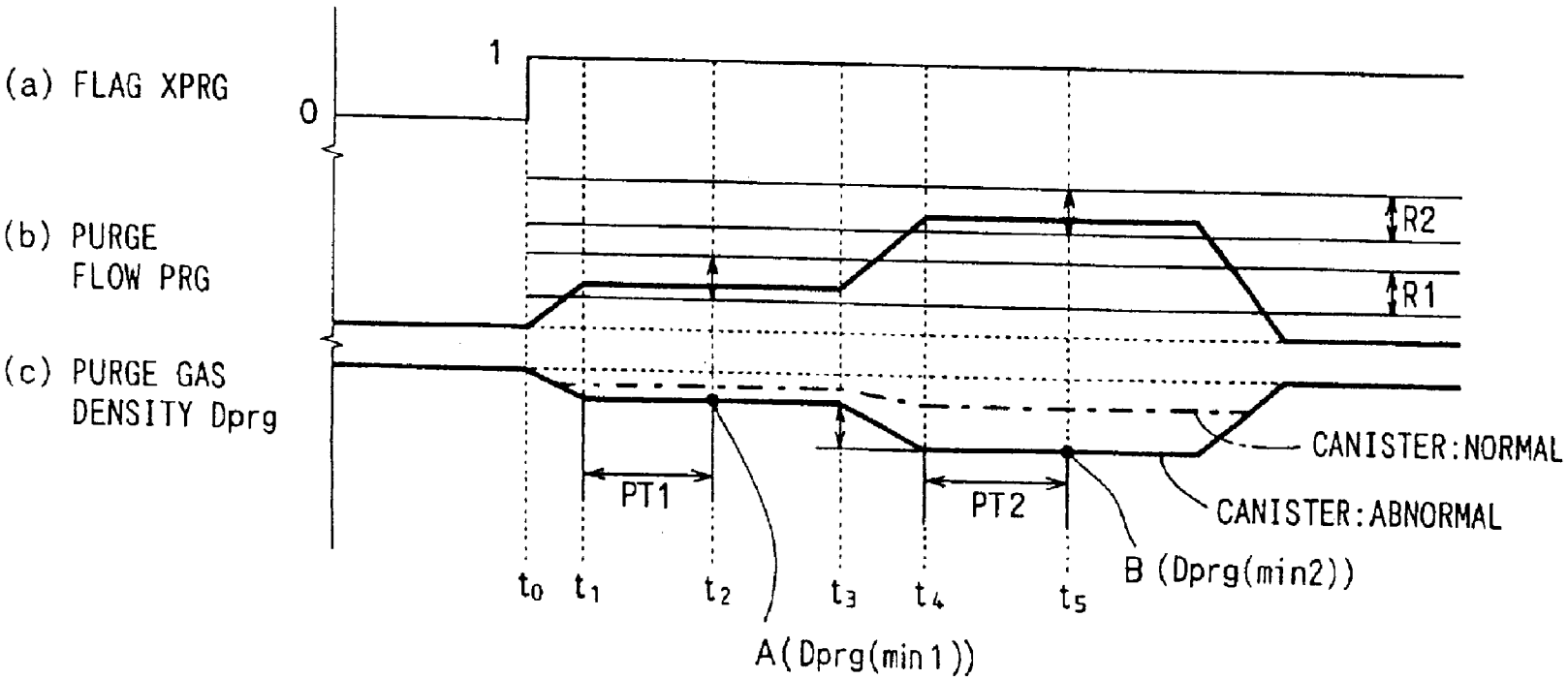
FIG. 29 is a timing chart showing a sequence of the process shown in FIG. 26.

Referring to timing chart shown in FIG. 29, timing in the process of the air permeability detection will be explained. Graph (a) in the chart shows whether the detecting conditions are satisfied and the purge flag XPRG is set. Graph (b) shows the amount of purge flow PRG. Graph (c) shows the learned purge gas density Dprg which is continuously renewed. Dprg of a canister having an abnormally low air permeability is shown by a solid line, while Dprg of a normal canister is shown by a dotted line.

At time $t_0$, the detecting conditions are satisfied and flag XPRG is set, and the PRG detection starts. At time $t_1$, PRG comes in the predetermined range R1. Thereafter, Dprg (min1) is continuously renewed. At time $t_2$ when the predetermined time period PT1 has lapsed from time $t_1$, Dprg (min1) renewed by that time is memorized and flag Fref1 is set. At time $t_3$, the amount of purge flow PRG is switched to a higher level. At time $t_4$, PRG comes in the predetermined range R2. Thereafter, Dprg(min2) is continuously renewed. At time $t_5$ when the predetermined time period PT2 has lapsed from time $t_4$, Dprg(min2) renewed by that time is memorized and flag Fref2 is set. Predetermined time periods PT1 and PT2 are necessary to obtain a stabilized Dprg, as explained above.

Thus, Dprg(min1) detected in the low purge flow range R1 (point A) and Dprg(min2) detected in the high purge flow range R2 (point F) are respectively set. Then, the difference between Dprg(min1) and Dprg(min2) is calculated and compared with the criterion value Vd. If the difference is larger than the criterion value Vd, it is determined that the canister air permeability is abnormally low.

Figure 28:
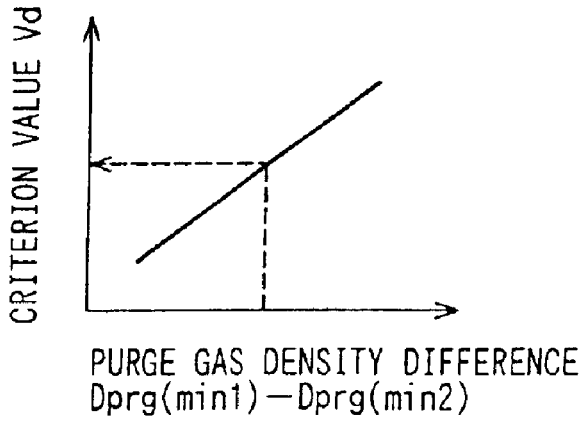
FIG. 28 is a graph showing a criterion value determined according to a purge gas density difference.

The criterion value Vd is set depending on the difference between Dprg(min1) and Dprg(min2), as shown in FIG. 28. As the difference becomes large, the criterion value Vd is set to a higher level. Alternatively, the criterion value may be set according to a time period between point A and point B (shown in FIG. 29). In this case, the criterion value is set to a higher level as that time period becomes longer. The canister abnormality detection may be prohibited if the time period between point A and point B is too long, or the previously learned purge gas density Dprg may be cleared. Further, when the time period reaches a predetermined length, the purge control valve may be compulsorily operated to set an amount of purge flow which is different from an initial amount by a predetermined amount, and then the learned purge gas density may be detected.

The time period between point A and point B may be set based on the integrated purge gas density Dprg(ad) calculated at step S1206 shown in FIG. 26. Since an amount of fuel absorbed by the canister changes in a higher degree in the purging period than in a period in which no purging is being performed, the time periods PT1 and PT2 can be accurately set by using the integrated value Dprg(ad).

While the present invention has been shown and described with reference to the foregoing preferred embodiments, it will be apparent to those skilled in the art that changes in form and detail may be made therein without departing from the scope of the invention as defined in the appended claims.

What is claimed is:

1. A device for detecting deterioration of a canister used in a fuel evaporation control system in which fuel evaporated from a fuel tank is absorbed by the canister and the absorbed gaseous fuel is purged into an intake pipe of an internal combustion engine, the canister being disposed in a passage connecting the fuel tank and the intake pipe, the detecting device comprising:

means for controlling an amount of purge gas flow purged into the intake pipe;

means for detecting a density of purge gas purged into the intake pipe;

means for detecting fuel-absorbing ability of the canister based on a deviation of the detected purge gas density; and means for memorizing a maximum level of the purge gas density detected during a purging process, wherein:

the deviation of the purge gas density is a difference between the purge gas density detected by the purge gas density detecting means and the maximum level of the purge gas density memorized in the memorizing means.

2. The detecting device as in claim 1, wherein:

the fuel-absorbing ability detecting means determines that the fuel-absorbing ability of the canister is abnormally low if the density difference detected in a predetermined time period is higher than a predetermined criterion value.

3. The detecting device as in claim 1, wherein:

the maximum level of the purge gas density is memorized when the purge gas density is higher than a predetermined level.

4. The detecting device as in claim 2, wherein:

the predetermined time period is counted from a time when the maximum level of the purge gas density is memorized.

5. The detecting device as in claim 2, further including means for integrating the purge gas density during the purging process, wherein:

the predetermined time period is set to a time period in which the integrated purge gas density reaches a predetermined level.

6. A device for detecting deterioration of a canister used in a fuel evaporation control system in which fuel evaporated from a fuel tank is absorbed by the canister and the absorbed gaseous fuel is purged into an intake pipe of an internal combustion engine, the canister being disposed in a passage connecting the fuel tank and the intake pipe, the detecting device comprising:

means for controlling an amount of purge gas flow purged into the intake pipe;

means for detecting a density of purge gas purged into the intake pipe; and means for detecting air permeability in the canister based on a deviation of the purge gas density detected under at least two different amounts of purge gas flow.

7. The detecting device as in claim 6, further including means for setting a criterion value, wherein:

the density deviation is a difference between a first purge gas density detected under a first amount of purge flow and a second purge gas density detected under a second amount of purge flow; and the air permeability detecting means determines that the air permeability in the canister is abnormally low if the density difference is larger than the criterion value.

8. The detecting device as in claim 7 wherein:

the criterion value setting means sets the criterion value based on a time period from a time when the first purge gas density is detected to a time when the second purge gas density is detected.

9. the detecting device as in claim 7, wherein:

the criterion value setting means sets the criterion value based on a difference between the first amount of purge flow and the second amount of purge flow.

10. The detecting device as in claim 7, wherein:

the second amount of purge flow is set when a first predetermined time period has lapsed after the first purge gas density is detected.

11. The detecting device as in claim 7, wherein:

the detected first purge gas density is cleared if a second predetermined time period has lapsed from a time when the first purge gas density is detected to a time when the second purge gas density is detected.

12. The detecting device as in claim 7, wherein:

the detection of the air permeability in the canister is prohibited if a second predetermined time period has lapsed from a time when the first purge gas density is detected to a time when the second purge gas density is detected.

13. The detecting device as in claim 7, further including a tank-cut valve for closing or opening a passage between the fuel tank and the canister, wherein:

the tank-cut valve is closed during a time period in which the detection of the air permeability in the canister is being performed.

14. The detecting device as in claim 7, wherein:

the detection of the air permeability in the canister is prohibited when the purge gas density detected by the purge gas density detecting means is higher than a predetermined level.

15. A device for detecting deterioration of a canister used in a fuel evaporation control system in which fuel evaporated from a fuel tank is absorbed by the canister and the absorbed gaseous fuel is purged into an intake pipe of an internal combustion engine, the canister being disposed in a passage connecting the fuel tank and the intake pipe, the detecting device comprising:

means for controlling an amount of purge gas flow purged into the intake pipe;

means for detecting a density of purge gas purged into the intake pipe; and means for detecting fuel-absorbing ability of the canister based on a deviation of the detected purge gas density, wherein said fuel-absorbing ability detecting means detects the fuel-absorbing ability based on the purge gas density deviation that occurs during a predetermined period of time in which no deviation would occur if the fuel-absorbing ability is normal.

16. A device for detecting deterioration of a canister used in a fuel evaporation control system in which fuel evaporated from a fuel tank is absorbed by the canister and the absorbed gaseous fuel is purged into an intake pipe of an internal combustion engine, the canister being disposed in a passage connecting the fuel tank and the intake pipe, the detecting device comprising:

means for controlling an amount of purge gas flow purged into the intake pipe;

means for detecting a density of purge gas purged into the intake pipe; and means for detecting fuel-absorbing ability of the canister based on a deviation of the detected purge gas density, wherein said fuel-absorbing ability detecting means detects a period of time in which the purge gas density decreases and determines a deterioration of the fuel-absorbing ability based on the detected period.

* * * * *